US011479941B2

(12) United States Patent
Igarashi et al.

(10) Patent No.: US 11,479,941 B2
(45) Date of Patent: Oct. 25, 2022

(54) WORK MACHINE

(71) Applicant: HITACHI CONSTRUCTION MACHINERY CO., LTD., Tokyo (JP)

(72) Inventors: Teruki Igarashi, Tsuchiura (JP); Shiho Izumi, Hitachinaka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 414 days.

(21) Appl. No.: 16/645,502

(22) PCT Filed: Dec. 20, 2018

(86) PCT No.: PCT/JP2018/047091
§ 371 (c)(1),
(2) Date: Mar. 9, 2020

(87) PCT Pub. No.: WO2019/124520
PCT Pub. Date: Jun. 27, 2019

(65) Prior Publication Data

US 2020/0277752 A1 Sep. 3, 2020

(30) Foreign Application Priority Data

Dec. 22, 2017 (JP) ..... JP2017-246929

(51) Int. Cl.
*E02F 3/43* (2006.01)
*E02F 9/22* (2006.01)
*E02F 9/26* (2006.01)

(52) U.S. Cl.
CPC ..... *E02F 3/435* (2013.01); *E02F 9/226* (2013.01); *E02F 9/26* (2013.01)

(58) Field of Classification Search
CPC . E02F 9/226; E02F 9/26; E02F 9/2033; E02F 9/2285; E02F 9/262; E02F 3/435
See application file for complete search history.

(56) References Cited

U.S. PATENT DOCUMENTS 6,275,757 B1 8/2001 Watanabe et al.
9,556,593 B2 * 1/2017 Nomura ..... G09G 5/02
(Continued)

FOREIGN PATENT DOCUMENTS

CN 1229449 A 9/1999
CN 106894455 A 6/2017
(Continued)

OTHER PUBLICATIONS

International Preliminary Report on Patentability received in corresponding International Application No. PCT/JP2018/047091 dated Jul. 2, 2020.

(Continued)

*Primary Examiner* — Tyler J Lee
*Assistant Examiner* — Yufeng Zhang
(74) *Attorney, Agent, or Firm* — Mattingly & Malur, PC

(57) ABSTRACT

A hydraulic excavator includes a controller having an actuator control section that executes machine control of operating a work implement in accordance with a predetermined condition in a case in which a work implement is positioned in a deceleration area, and that does not execute machine control in a case in which the work implement is positioned in a non-deceleration area. The controller further includes an operation deciding section that decides operation of the work implement on the basis of an operation amount of an operation device, and a display control section that displays, on a display device, a positional relationship among the work implement, a target surface and a boundary line between the deceleration area and the non-deceleration area. The actuator control section executes machine control while changing the position of the boundary line depending on a result of the decision by the operation deciding section, and the display control section changes the display position of (Continued)

the boundary line on the display device, depending on the result of the decision by the operation deciding section.

7 Claims, 24 Drawing Sheets

(56) References Cited

U.S. PATENT DOCUMENTS

| | | | | |
|---|---|---|---|---|
| 2015/0050110 | A1 | 2/2015 | Matsuyama et al. | |
| 2016/0024757 | A1* | 1/2016 | Nomura | E02F 9/264 701/32.3 |
| 2016/0376772 | A1* | 12/2016 | Kondo | E02F 9/264 701/34.4 |

FOREIGN PATENT DOCUMENTS

| | | | |
|---|---|---|---|
| JP | 2004-068433 | A | 3/2004 |
| JP | 2013-217138 | A | 10/2013 |
| WO | 1995/030059 | A1 | 11/1995 |
| WO | 2016/148251 | A1 | 9/2016 |

OTHER PUBLICATIONS

Chinese Office Action received in corresponding Chinese Application No. 201880054844.0 dated Jun. 2, 2021.
International Search Report of PCT/JP2018/047091 dated Mar. 26, 2019.

* cited by examiner

| Ya[m] | DECELERATION RATE h AT TIME OF ARM-DUMPING + BOOM-LOWERING |
|---|---|
| 0.8Ya2 | 1.0 |
| 0.5Ya2 | 0.8 |
| 0.2Ya2 | 0.4 |
| 0.0 | 0.0 |

| Ya[m] | DECELERATION RATE h AT TIME OF ONLY ARM-DUMPING OPERATION |
|---|---|
| Ya2 | 1.0 |
| 0.5Ya2 | 0.5 |
| 0.2Ya2 | 0.2 |
| 0.0 | 0.0 |

WORK MACHINE

TECHNICAL FIELD

The present invention relates to a work machine that can execute machine control.

BACKGROUND ART

Hydraulic excavators are provided with control systems to assist excavating operation performed by operators in some cases. Specifically, in a case in which excavating operation (e.g. an instruction for arm crowding) is input via an operation device, a control system executes control of forcibly operating at least a boom cylinder among a boom cylinder, the arm cylinder and a bucket cylinder that drive a work implement (also called a front work implement) (e.g. forcibly performing boom-raising operation by extending the boom cylinder) such that the position of the tip of the work implement (e.g. the claw tip of a bucket) is kept on a target surface and within an area above the target surface, on the basis of a positional relationship between the target surface and the tip of the work implement. Use of such a control system that restricts an area within which the tip of a work implement can move enhances finishing work of an excavated surface and shaping work of a face of slope. Hereinbelow, this type of control is referred to as "machine control (MC: Machine Control)," "area-restricting control" or "interventional control (on operator operation)" in some cases.

Patent Document 1 discloses a hydraulic excavator including this type of control system. The control system calculates a target velocity vector at the bucket tip on the basis of a signal from an operation device (operation lever), and when a front work implement is in a deceleration area (a set area) set above a target surface (a boundary of the set area), the control system controls a boom cylinder by machine control such that a vector component of the target velocity vector in the direction toward the target surface decreases. When the front work implement is in an area above the deceleration area (non-deceleration area), the control system does not perform machine control, but keeps the target velocity vector unchanged.

In addition, there is a display system that visually guides work of a hydraulic excavator by displaying an image of a target surface and a bucket on a display device. Patent Document 2 discloses an excavator that sets a reference surface (an excavation reference line RTL) to a position closer to a ground surface than a target surface, compares the height of a bucket with the height of the reference surface, and performs guidance by means of a message sound on the basis of a result of the comparison. This document also discloses that a plurality of work reference lines (work-amount reference lines WTL1 and WTL2) are set at heights different from the reference surface, and different message sounds are used for the different work reference lines.

PRIOR ART DOCUMENT

Patent Documents

Patent Document 1: WO1995/030059
Patent Document 2: WO2016/148251

SUMMARY OF THE INVENTION

Problems to be Solved by the Invention

In a case in which excavation work along a target surface is performed with the hydraulic excavator in Patent Document 1, an operator performs withdrawing work of withdrawing a bucket to an excavation start point again by arm-dumping operation after the bucket is moved from the excavation start point to a position close to the machine-body along the target surface by arm-crowding operation. In addition, also in a case in which levelling work along a target surface is performed, an operator performs withdrawing work of withdrawing a bucket to a levelling start point again by arm-dumping operation after the bucket is moved from the levelling start point to a position close to the machine-body along the target surface by arm-crowding operation. Withdrawing work is performed repeatedly in excavation work and levelling work. Because of this, the length of time required for withdrawing work is preferably shorter from the perspective of improving the work efficiency.

In Patent Document 1, when a bucket is positioned in a deceleration area, the velocity of a front work implement is inevitably decelerated always irrespective of the intention of an operator, but the boundary of the deceleration area is not clearly presented to the operator. Because of this, in a case in which the bucket passes through the deceleration area during withdrawing work, the velocity of the front work implement is inevitably decelerated against the intention of the operator, and there is a fear that this results in deterioration of work efficiency. For the improvement of work efficiency, preferably, the operator is made recognize the boundary of the deceleration area, and operates the work implement such that the work implement does not pass through the deceleration area as much as possible during withdrawing work.

Note that the technology in Patent Document 2 merely makes an operator recognize how much excavation has been done from a ground surface to a target surface by setting reference surfaces or work reference lines between the ground surface and a target surface, and issuing a message sound. The technology cannot be used to make the operator recognize the boundaries of deceleration areas defined at predetermined distances from the target surface (reference surfaces, and work reference lines).

An object of the present invention is to provide a work machine that can make an operator recognize an area for enabling execution of machine control.

Means for Solving the Problems

The present application includes a plurality of means for solving the problems explained above, and if one example of the means is to be mentioned, it is a work machine including: an articulated-type work implement; a plurality of hydraulic actuators that drive the work implement; an operation device that instructs the work implement to operate depending on operation performed by an operator; a controller that executes machine control of operating the work implement in accordance with a predetermined condition in a case in which the work implement is positioned in a first area set above a target surface set as desired, and that does not execute the machine control in a case in which the work implement is positioned in a second area set above the first area; and a display device on which a positional relationship between the target surface and the work implement is displayed. In the work machine, the controller decides operation of the work implement on a basis of an operation amount of the operation device; displays, on the display device, a positional relationship among the work implement, the target surface and a boundary line between the first area and the second area; executes the machine control while changing a position of the boundary line depending on a result of the decision of the operation of the work implement; and changes a display position of the boundary line on the display device depending on the result of the decision of the operation of the work implement.

Advantages of the Invention

According to the present invention, the position of the boundary line between an area for enabling execution of machine control and an area for disabling execution of machine control is displayed on a display device along with the position of a work implement, and an operator can operate the work implement by referring to the displayed positions. Accordingly, the length of time during which the work implement passes, while performing withdrawing work, through the area within which machine control is executed decreases, and the work efficiency can be improved.

MODES FOR CARRYING OUT THE INVENTION

Figure 1:
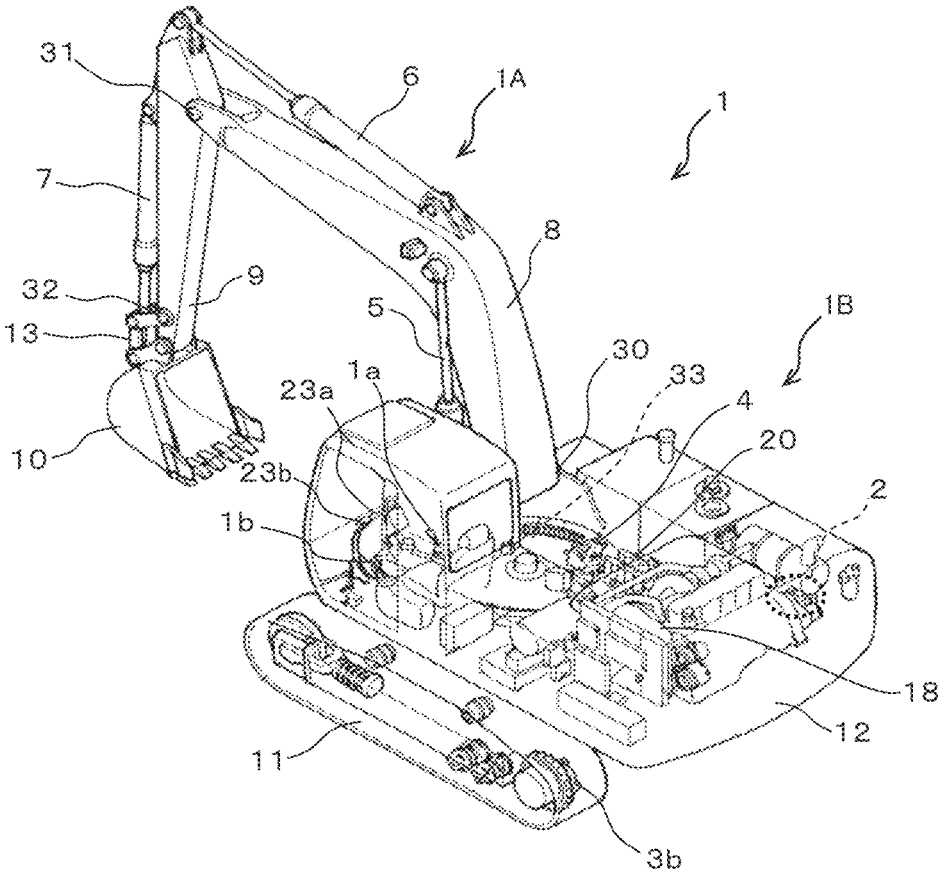
FIG. 1 is a configuration diagram of a hydraulic excavator.

Hereinafter, embodiments of the present invention are explained by using the drawings. Note that although a hydraulic excavator provided with a bucket 10 as a work tool (attachment) at the tip of a work implement is illustrated as an example hereinbelow, the present invention is allowed to be applied to a work machine provided with an attachment other than a bucket. Furthermore, the present invention can also be applied to work machines other than hydraulic excavators as long as the work machines are ones having articulated-type work implements constituted by coupling a plurality of link members (an attachment, an arm, a boom and the like).

In addition, in this document, words such as "on," "above" or "below" used along with terms indicating certain shapes (e.g. a target surface, a design surface and the like) have the following correspondences. "On" corresponds to a "surface" with the certain shapes. "Above" corresponds to a "position higher than the surface" with the certain shapes. "Below" corresponds to a "position lower than the surface" with the certain shape. In addition, in the following explanation, in a case in which there are a plurality of identical components, alphabets are given at the ends of reference characters (numbers) of the components in some cases, but the plurality of components are denoted collectively in some cases by omitting the alphabets. For example, when there are three pumps 300*a*, 300*b* and 300*c*, they are denoted collectively as the pumps 300 in some cases.

Overall Configuration of Hydraulic Excavator

Figure 2:
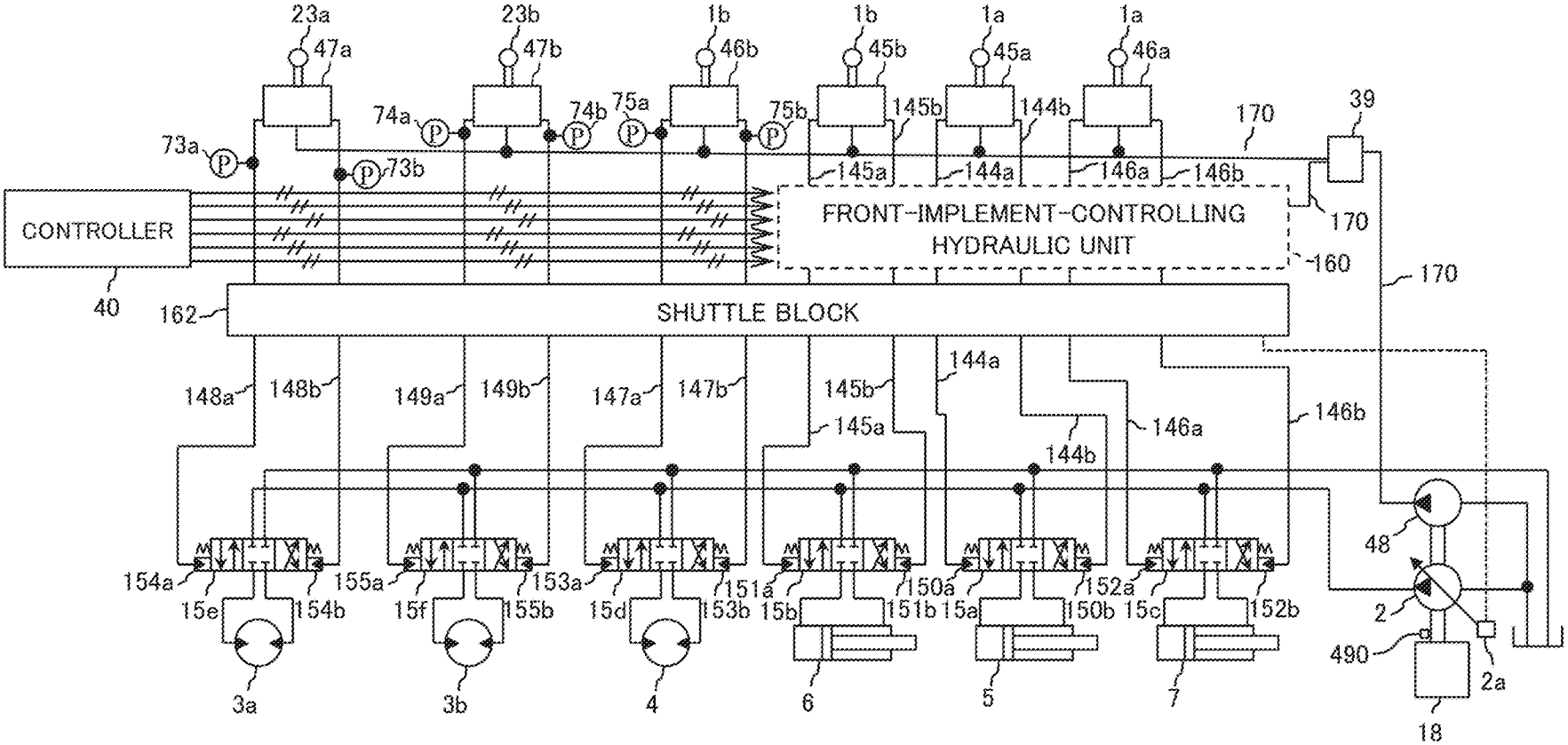
FIG. 2 is a diagram illustrating a controller of the hydraulic excavator along with a hydraulic drive system.
Figure 3:
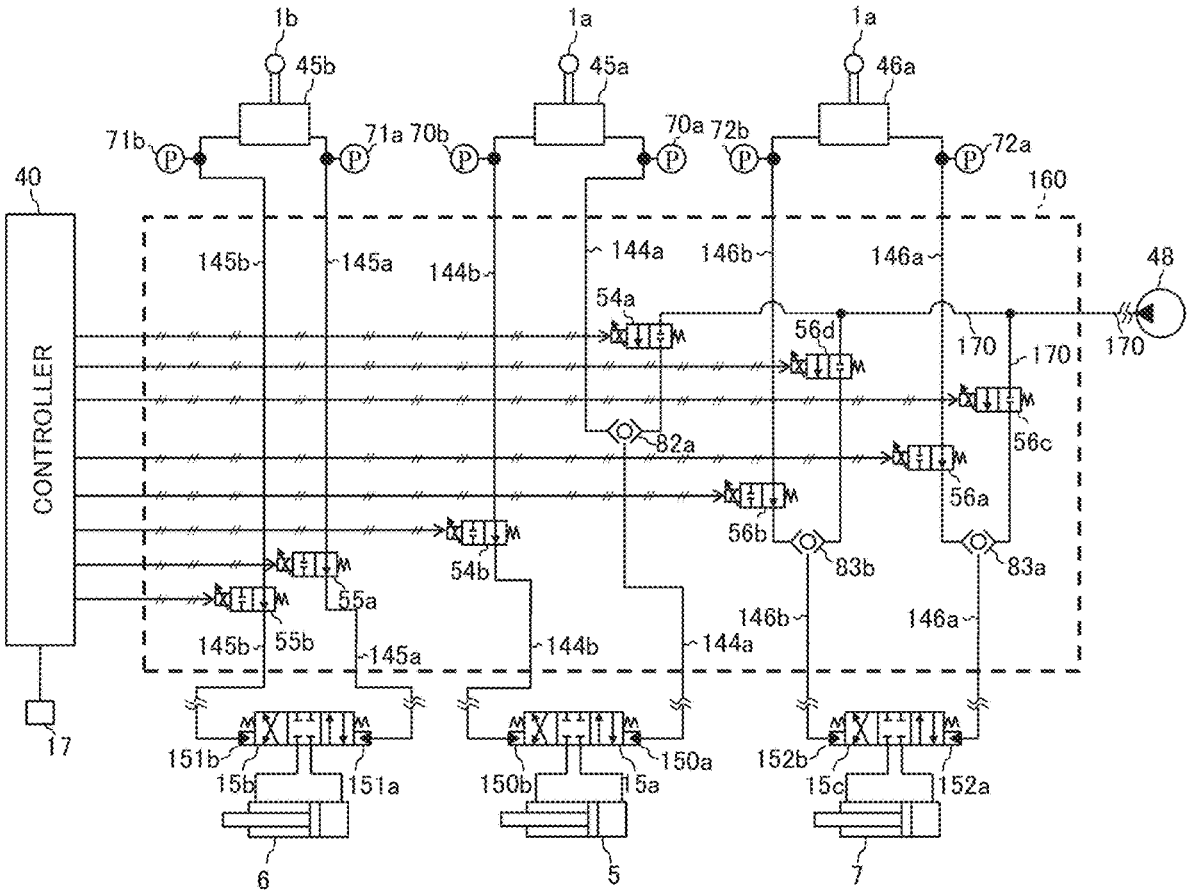
FIG. 3 is a detail diagram of a front-implement-controlling hydraulic unit 160 in FIG. 2.

FIG. 1 is a configuration diagram of a hydraulic excavator according to an embodiment of the present invention, FIG. 2 is a diagram illustrating a controller of the hydraulic excavator according to the embodiment of the present invention along with a hydraulic drive system, and FIG. 3 is a detail diagram of a front-implement-controlling hydraulic unit 160 in FIG. 2.

In FIG. 1, a hydraulic excavator 1 is constituted by an articulated-type front work implement 1A, and a machine-body 1B. The machine-body 1B includes a lower track structure 11 that travels with left and right travel hydraulic motors 3*a* and 3*b* (see FIG. 2 for the hydraulic motor 3*a*), and an upper swing structure 12 that is attached on the lower track structure 11, and is caused to swing by a swing hydraulic motor 4.

The front work implement 1A is constituted by coupling a plurality of driven members (a boom 8, an arm 9 and a bucket 10) that pivot in the vertical direction individually. The base end of the boom 8 is pivotably supported at a front portion of the upper swing structure 12 via a boom pin. The arm 9 is pivotably coupled to the tip of the boom 8 via an arm pin, and the bucket 10 is pivotably coupled to the tip of the arm 9 via a bucket pin. The boom 8 is driven by a boom cylinder 5, the arm 9 is driven by an arm cylinder 6, and the bucket 10 is driven by a bucket cylinder 7.

In order to make measurement of angles of pivoting motion α, β and γ (see FIG. 5) of the boom 8, the arm 9 and the bucket 10 possible, a boom-angle sensor 30, an arm-angle sensor 31 and a bucket-angle sensor 32 are attached to the boom pin, the arm pin and a bucket link 13, respectively, and a machine-body inclination-angle sensor 33 that senses an inclination angle θ (see FIG. 5) of the upper swing structure 12 (the machine-body 1B) to a reference plane (e.g. the horizontal plane) is attached to the upper swing structure 12. Note that the angle sensors 30, 31 and 32 can each be replaced with an angle sensor to sense an angle to a reference plane (e.g. the horizontal plane).

An operation device 47*a* (FIG. 2) that has a travel right lever 23*a* (FIG. 1) and is for operating the travel right hydraulic motor 3*a* (the lower track structure 11), an operation device 47*b* (FIG. 2) that has a travel left lever 23*b* (FIG. 1) and is for operating the travel left hydraulic motor 3*b* (the lower track structure 11), operation devices 45*a* and 46*a* (FIG. 2) that share an operation right lever 1*a* (FIG. 1) and are for operating the boom cylinder 5 (the boom 8) and the bucket cylinder 7 (the bucket 10), operation devices 45*b* and 46*b* (FIG. 2) that share an operation left lever 1*b* (FIG. 1) and are for operating the arm cylinder 6 (the arm 9) and the swing hydraulic motor 4 (the upper swing structure 12) are installed in a cab provided to the upper swing structure 12. Hereinbelow, the travel right lever 23*a*, the travel left lever 23*b*, the operation right lever 1*a* and the operation left lever 1*b* are collectively referred to as operation levers 1 and 23 in some cases.

An engine 18 which is a prime mover mounted on the upper swing structure 12 drives a hydraulic pump 2 and a pilot pump 48. The hydraulic pump 2 is a variable displacement pump whose capacity is controlled by a regulator 2*a*, and the pilot pump 48 is a fixed displacement pump. In the present embodiment, a shuttle block 162 is provided on pilot lines 144, 145, 146, 147, 148 and 149 as illustrated in FIG. 2. Hydraulic signals output from the operation devices 45, 46 and 47 are input also to the regulator 2*a* via the shuttle block 162. Although the detail configuration of the shuttle block 162 is omitted, a hydraulic signal is input to the regulator 2*a* via the shuttle block 162, and the delivery flow rate of the hydraulic pump 2 is controlled depending on the hydraulic signal.

A pump line 170 which is a line for delivery from the pilot pump 48 passes through a lock valve 39, and then is branched into a plurality of lines which are connected to valves in the operation devices 45, 46 and 47, and the front-implement-controlling hydraulic unit 160. The lock valve 39 is a solenoid selector valve in the present example, and its solenoid drive section is electrically connected with a position sensor of a gate lock lever (not illustrated) arranged in the cab of the upper swing structure 12. The position of the gate lock lever is sensed at the position sensor, and a signal depending on the position of the gate lock lever is input from the position sensor to the lock valve 39. When the position of the gate lock lever is at the lock position, the lock valve 39 is closed to interrupt communication through the pump line 170, and when the position of the gate lock lever is at the unlock position, the lock valve 39 is opened to establish communication through the pump line 170. That is, in the state where communication through the pump line 170 is interrupted, operation by the operation devices 45, 46 and 47 is disabled, and operation such as swings or excavation is prohibited.

The operation devices 45, 46 and 47 are hydraulic pilot operation devices, and individually produce pilot pressures (referred to as operation pressures in some cases) depending on operation amounts (e.g. lever strokes) and operation directions of the operation levers 1 and 23 operated by an operator, on the basis of a hydraulic fluid delivered from the pilot pump 48. The thus-produced pilot pressures are supplied to hydraulic drive sections 150*a* to 155*b* of corresponding flow control valves 15*a* to 15*f* (see FIG. 2 or FIG. 3) in a control valve unit 20 via pilot lines 144*a* to 149*b* (see FIG. 3), and are used as control signals to drive the flow control valves 15*a* to 15*f*.

The hydraulic fluid delivered from the hydraulic pump 2 is supplied to the travel right hydraulic motor 3*a*, the travel left hydraulic motor 3*b*, the swing hydraulic motor 4, the boom cylinder 5, the arm cylinder 6 and the bucket cylinder 7 via the flow control valves 15*a*, 15*b*, 15*c*, 15*d*, 15*e* and 15*f* (see FIG. 3). The boom cylinder 5, the arm cylinder 6 and the bucket cylinder 7 are extended or contracted by the supplied hydraulic fluid to thereby cause the boom 8, the arm 9 and the bucket 10 to pivot, respectively, and change the position and posture of the bucket 10. In addition, the swing hydraulic motor 4 is rotated by the supplied hydraulic fluid to thereby cause the upper swing structure 12 to swing relative to the lower track structure 11. Then, the travel right hydraulic motor 3*a* and the travel left hydraulic motor 3*b* are rotated by the supplied hydraulic fluid to thereby cause the lower track structure 11 to travel.

Figure 4:
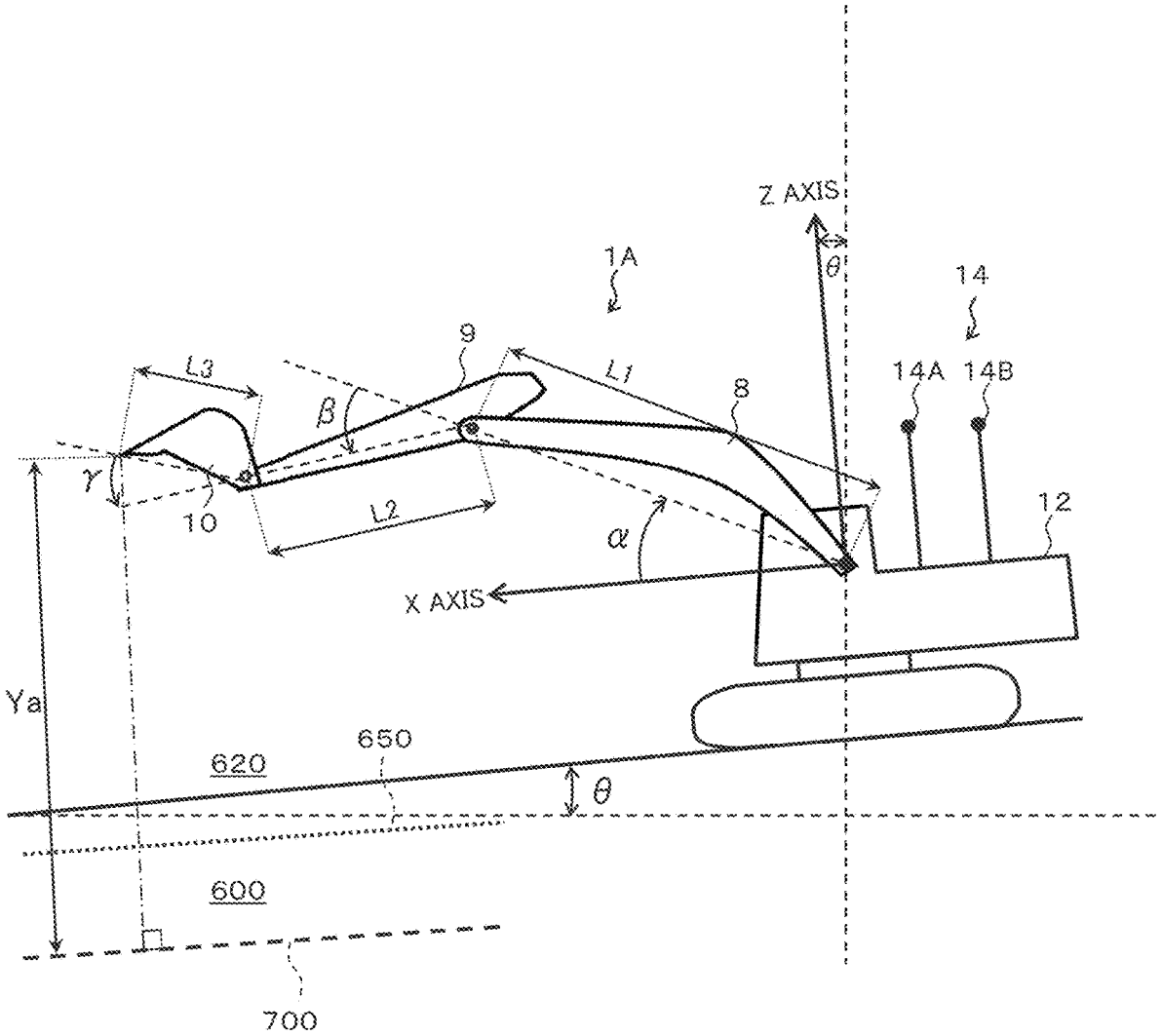
FIG. 4 is a figure illustrating a coordinate system relative to the hydraulic excavator in FIG. 1, and a target surface.

The posture of the work implement 1A can be defined on the basis of an excavator reference coordinate in FIG. 4. The excavator reference coordinate in FIG. 4 is a coordinate set relative to the upper swing structure 12, has its origin at a bottom portion of the boom 8, and has its Z axis and X axis that are set along the vertical direction and the horizontal direction of the upper swing structure 12, respectively. The inclination angle of the boom 8 relative to the X axis is defined as the boom angle α, the inclination angle of the arm 9 relative to the boom is defined as the arm angle β, and the inclination angle of the bucket claw tip relative to the arm is defined as the bucket angle γ. The inclination angle of the machine-body 1B (the upper swing structure 12) relative to the horizontal plane (the reference plane) is defined as the inclination angle θ. The boom angle α is sensed by the boom-angle sensor 30, the arm angle β is sensed by the arm-angle sensor 31, the bucket angle γ is sensed by the bucket-angle sensor 32, and the inclination angle θ is sensed by the machine-body inclination-angle sensor 33. The boom angle α becomes the smallest when the boom 8 is raised to the maximal (highest) position (when the boom cylinder 5 is extended to its stroke end in the raising direction, that is, when the boom-cylinder length is longest), and becomes the largest when the boom 8 is lowered to its minimal (lowest)

position (when the boom cylinder 5 is contracted to its stroke end in the lowering direction, that is, when the boom-cylinder length is shortest). The arm angle β becomes the smallest when the arm-cylinder length is shortest, and becomes the largest when the arm-cylinder length is longest. The bucket angle γ becomes the smallest when the bucket-cylinder length is shortest (as illustrated in FIG. 4), and becomes the largest when the bucket-cylinder length is longest. At this time, when the length from the bottom portion of the boom 8 to a connecting section between the boom 8 and the arm 9 is defined as L1, the length from the connecting section between the arm 9 and the boom 8 to a connecting section between the arm 9 and the bucket 10 is defined as L2, and the length from the connecting section between the arm 9 and the bucket 10 to a tip portion of the bucket 10 is defined as L3, the tip position of the bucket 10 in the excavator reference coordinate can be expressed by the following formula, assuming that $X_{bk}$ means the X-direction position, and $Z_{bk}$ means the Z-direction position.

$$X_{bk}=L_1\cos(\alpha)+L_2\cos(\alpha+\beta)+L_3\cos(\alpha+\beta+\gamma) \quad \text{[Equation 1]}$$

$$Z_{bk}=L_1\sin(\alpha)+L_2\sin(\alpha+\beta)+L_3\sin(\alpha+\beta+\gamma) \quad \text{[Equation 2]}$$

In addition, the hydraulic excavator 1 includes a pair of GNSS (Global Navigation Satellite System) antennas 14A and 14B at the upper swing structure 12 as illustrated in FIG. 4. On the basis of information from the GNSS antennas 14, the position of the hydraulic excavator 1 and the position of the bucket 10 in the global coordinate system can be computed.

Figure 5:
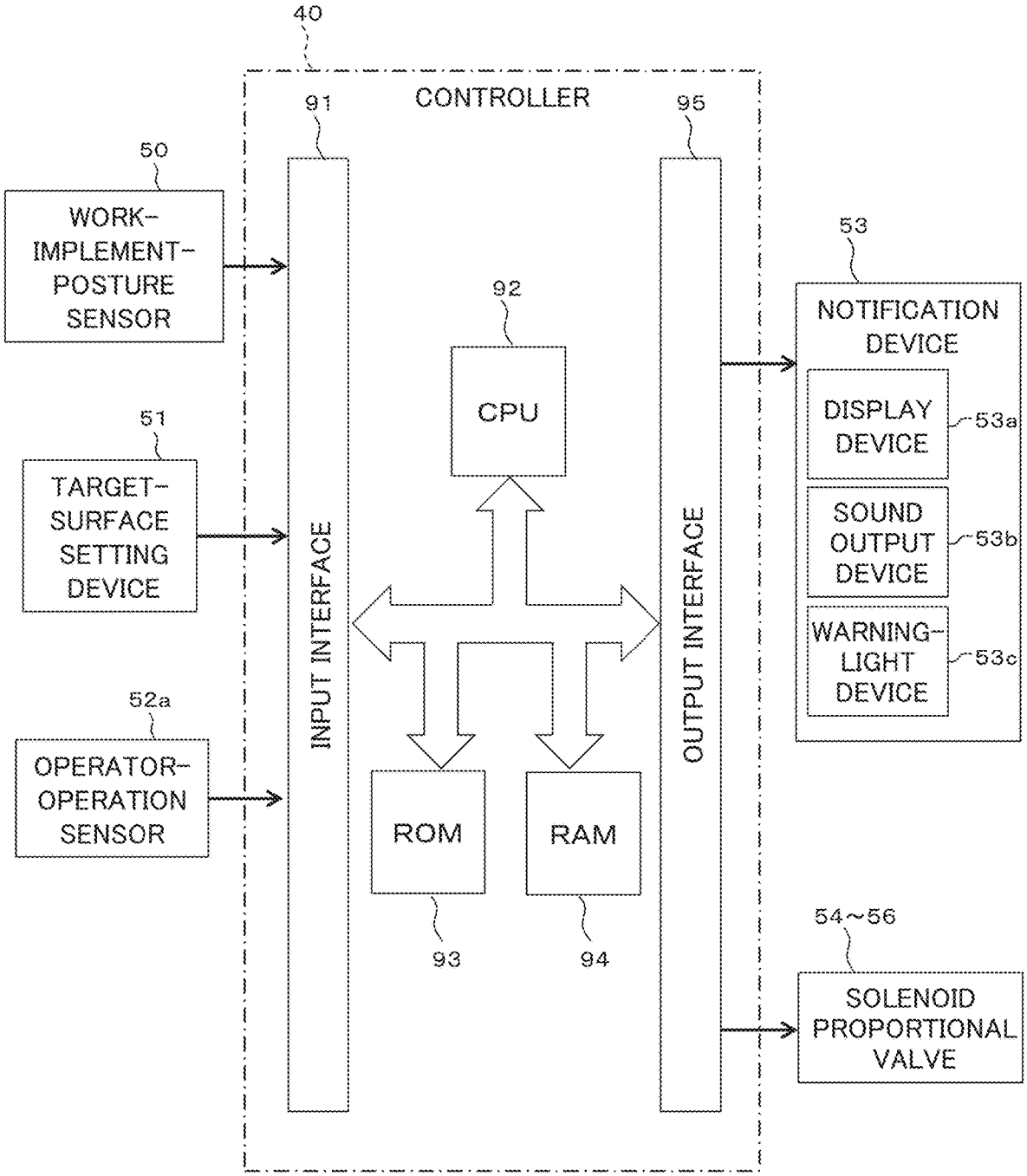
FIG. 5 is a hardware configuration diagram of a controller 40 of the hydraulic excavator.

FIG. 5 is a configuration diagram of a machine guidance (Machine Guidance: MG) and machine control (Machine Control: MC) system provided to the hydraulic excavator according to the present embodiment.

As MC of the front work implement 1A in the present system, control of operating the work implement 1A in accordance with a predetermined condition is executed in a case in which the operation devices 45*a*, 45*b* and 46*a* are operated, and the work implement 1A is positioned in a deceleration area (first area) 600 which is a predetermined closed area set above a target surface 700 set as desired (see FIG. 4). Specifically, when the work implement 1A is in the deceleration area 600, MC of controlling at least one of the plurality of hydraulic actuators 5, 6 and 7 is performed such that a vector component in the direction toward the target surface 700 in a velocity vector at a tip portion (e.g. the claw tip of the bucket 10) of the work implement 1A decreases as the tip portion of the work implement 1A comes closer to the target surface 700 (details are mentioned below). The control of the hydraulic actuator 5, 6 or 7 is performed by forcibly outputting a control signal to a relevant one of the flow control valves 15*a*, 15*b* and 15*c* (e.g. a signal instructing the boom cylinder 5 to extend to forcibly perform boom-raising operation). Since this MC prevents the claw tip of the bucket 10 from going down into the target surface 700, excavation along the target surface 700 becomes possible irrespective of the level of the skill of an operator. On the other hand, in a case in which the work implement 1A is positioned in a non-deceleration area (second area) 620 set above and adjacent to the deceleration area 600, MC is not executed, and the work implement 1A is operated so as to be instructed through operation by an operator. A dotted line 650 in FIG. 4 is the boundary line between the deceleration area 600 and the non-deceleration area 620.

Note that although a control point of the front work implement 1A at the time of MC is set to the claw tip of the bucket 10 (the tip of the work implement 1A) of the hydraulic excavator in the present embodiment, the control point can also be changed to a point other than the bucket claw tip as long as the control point is a point at a tip portion of the work implement 1A. For example, the bottom surface of the bucket 10 and an outermost section of the bucket link 13 can also be selected, and a configuration in which a point on the bucket 10 located closest to the target surface 700 is set as a control point as appropriate may be adopted. In addition, in this document, in contrast to "automatic control" of controlling operation of the work implement 1A by the controller when the operation devices 45 and 46 are not being operated, MC is referred to as "semi-automatic control" of controlling operation of the work implement 1A by the controller only at the time of operation of the operation devices 45 and 46 in some cases.

Figure 13:
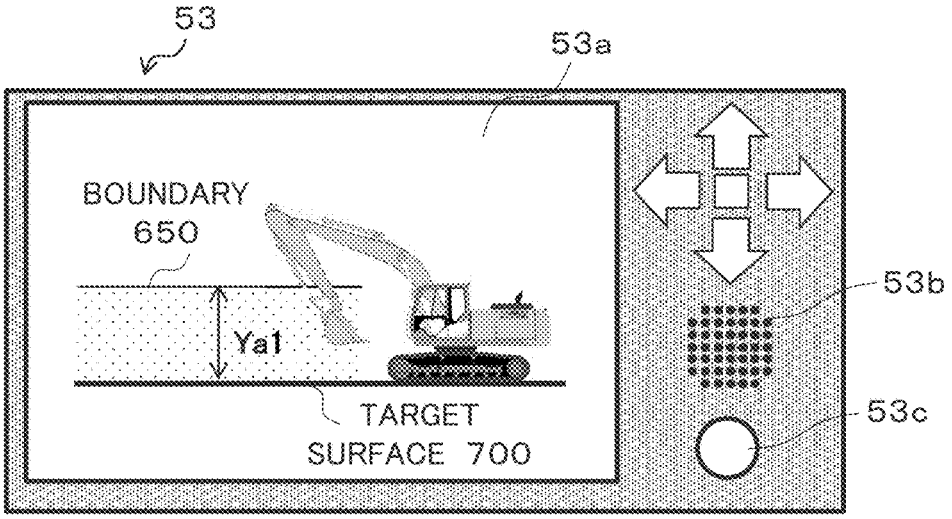
FIG. 13 is a figure illustrating one example of the configuration diagram of a notification device 53.

In addition, in MG of the front work implement 1A in the present system, a process of displaying, on a display device 53*a*, a positional relationship among the work implement 1A (e.g. the bucket 10), the target surface 700 and the boundary line 650 between the deceleration area 600 and the non-deceleration area 620 is performed as illustrated in FIG. 13 mentioned below, for example. By displaying the boundary line 650 between the deceleration area 600 and the non-deceleration area 620 on the display device 53*a*, it becomes possible to make an operator grasp the positional relationship between the deceleration area 600 and the work implement 1A. Thereby, it is possible to suppress frequent occurrence of situations where the work implement 1A goes into the deceleration area 600 against the intention of the operator, resulting in deceleration of the work implement 1A in a scene where quick operation is required for the work implement 1A (e.g. withdrawing work of withdraw the bucket to an excavation start point).

The system in FIG. 5 includes: a work-implement-posture sensor 50; a target-surface setting device 51, an operator-operation sensor 52*a*; the display device 53*a* on which a positional relationship between the target surface 700 and the work implement 1A can be displayed; a sound output device 53*b* that informs with a beep (sound) that the work implement 1A is coming close to the deceleration area 600 in which MC is executed; a warning-light device 53*b* that informs with a warning light that the work implement 1A is coming close to the deceleration area 600; and a controller 40 that is responsible for MG and MC.

The work-implement-posture sensor 50 is constituted by the boom-angle sensor 30, the arm-angle sensor 31, the bucket-angle sensor 32 and the machine-body inclination-angle sensor 33. These angle sensors 30, 31, 32 and 33 function as posture sensors of the work implement 1A.

The target-surface setting device 51 is an interface through which information related to the target surface 700 (including positional information and inclination-angle information of each target surface) can be input. The target-surface setting device 51 is connected with an external terminal (not illustrated) in which three-dimensional data of a target surface defined on the global coordinate system (absolute coordinate system) is stored. Note that input of a target surface through the target-surface setting device 51 may be performed manually by an operator.

The operator-operation sensor 52*a* is constituted by pressure sensors 70*a*, 70*b*, 71*a*, 71*b*, 72*a* and 72*b* that acquire operation pressures (first control signals) generated in the pilot lines 144, 145 and 146 through operation of the operation levers 1*a* and 1*b* (operation devices 45*a*, 45*b* and 46*a*) by an operator. That is, the operation on the hydraulic cylinders 5, 6 and 7 related to the work implement 1A is sensed.

The display device 53*a*, the sound output device 53*b* and the warning-light device 53*c* are installed in the cab. Note that these three devices 53*a*, 53*b* and 53*c* are collectively referred to as a notification device 53 in some cases in this document.

Front-Implement-Controlling Hydraulic Unit 160

As illustrated in FIG. 3, the front-implement-controlling hydraulic unit 160 includes: the pressure sensors 70*a* and 70*b* that are provided in the pilot lines 144*a* and 144*b* of the operation device 45*a* for the boom 8, and sense pilot pressures (first control signals) as operation amounts of the operation lever 1*a*; a solenoid proportional valve 54*a* that has a primary-port side connected to the pilot pump 48 via the pump line 170, reduces a pilot pressure from the pilot pump 48, and outputs the reduced pressure; a shuttle valve 82*a* that is connected to the pilot line 144*a* of the operation device 45*a* for the boom 8, and a secondary-port side of the solenoid proportional valve 54*a*, selects the higher one of a pilot pressure in the pilot line 144*a* and the controlled pressure (second control signal) output from the solenoid proportional valve 54*a*, and guides the selected pressure to the hydraulic drive section 150*a* of the flow control valve 15*a*; and a solenoid proportional valve 54*b* that is installed in the pilot line 144*b* of the operation device 45*a* for the boom 8, reduces a pilot pressure (first control signal) in the pilot line 144*b* on the basis of a control signal from a controller 40, and outputs the reduced pressure.

In addition, the front-implement-controlling hydraulic unit 160 is provided with: the pressure sensors 71*a* and 71*b* that are installed in the pilot lines 145*a* and 145*b* for the arm 9, sense pilot pressures (first control signals) as operation amounts of the operation lever 1*b*, and output the sensed pilot pressures to the controller 40; a solenoid proportional valve 55*b* that is installed in the pilot line 145*b*, reduces a pilot pressure (first control signal) on the basis of a control signal from the controller 40, and outputs the reduced pressure; and a solenoid proportional valve 55*a* that is installed in the pilot line 145*a*, reduces a pilot pressure (first control signal) in the pilot line 145*a* on the basis of a control signal from the controller 40, and outputs the reduced pressure.

In addition, in the front-implement-controlling hydraulic unit 160, the pilot lines 146*a* and 146*b* for the bucket 10 are provided with: the pressure sensors 72*a* and 72*b* that sense pilot pressures (first control signals) as operation amounts of the operation lever 1*a*, and output the sensed pilot pressures to the controller 40; solenoid proportional valves 56*a* and 56*b* that reduce pilot pressures (first control signals) on the basis of a control signal from the controller 40, and output the reduced pressures; solenoid proportional valves 56*c* and 56*d* that have primary-port sides connected to the pilot pump 48, reduce pilot pressures from the pilot pump 48, and outputs the reduced pressures; and shuttle valves 83*a* and 83*b* that select the higher one of pilot pressures in the pilot lines 146*a* and 146*b* and the controlled pressures output from the solenoid proportional valves 56*c* and 56*d*, and guide the selected pressures to hydraulic drive sections 152*a* and 152*b* of the flow control valve 15*c*, respectively. Note that connection lines between the pressure sensors 70, 71 and 72 and the controller 40 are omitted in FIG. 3 due to space-related reasons.

The solenoid proportional valves 54*b*, 55*a*, 55*b*, 56*a* and 56*b* have the largest openings when electric current is not flowing therethrough, and the openings become smaller as electric current, which is a control signal from the controller 40, becomes larger. On the other hand, the solenoid proportional valves 54*a*, 56*c* and 56*d* are closed when electric current is not flowing therethrough, and are opened when electric current is flowing therethrough, and the openings become larger as electric current (a control signal) from the controller 40 becomes larger. In this way, the openings of the solenoid proportional valves 54, 55 and 56 are ones according to the control signal from the controller 40.

In the thus-configured control hydraulic unit 160, when a control signal is output from the controller 40 to drive any of the solenoid proportional valves 54*a*, 56*c* and 56*d*, a pilot pressure (a second control signal) can be produced also in a case in which there is not operator operation of a corresponding operation device 45*a* or 46*a*, and so boom-raising operation, bucket-crowding operation and bucket-dumping operation can be produced forcibly. In addition, in a similar manner to this, by driving the solenoid proportional valves 54*b*, 55*a*, 55*b*, 56*a* and 56*b* by the controller 40, pilot pressures (second control signals) which are reduced by pilot pressures (first control signals) produced by operator operation of the operation devices 45*a*, 45*b* and 46*a* can be produced, and the velocity of boom-lowering operation, arm-crowding/dumping operation, bucket-crowding/dumping operation can be forcibly made lower than values of the operator operation.

In this document, among control signals for the flow control valves 15*a* to 15*c*, pilot pressures that are produced by operation of the operation devices 45*a*, 45*b* and 46*a* are referred to as "first control signals." Then, among control signals for the flow control valves 15*a* to 15*c*, pilot pressures generated by correcting (reducing) the first control signals by driving the solenoid proportional valves 54*b*, 55*a*, 55*b*, 56*a* and 56*b* by the controller 40, and pilot pressures generated newly and separately from the first control signals by driving the solenoid proportional valves 54*a*, 56*c* and 56*d* by the controller 40 are referred to as "second control signals."

A second control signal is generated when a velocity vector of a control point of the work implement 1A produced by a first control signal fails to meet a predetermined condition, and is generated as a control signal that produces a velocity vector of the control point of the work implement 1A that does not fail to meet the predetermined condition. Note that in a case in which a first control signal is generated for one of hydraulic drive sections of one of the flow control valves 15*a* to 15*c*, and in which a second control signal is generated for the other hydraulic drive section of the one flow control valve, the second control signal is prioritized as a signal to be applied to the hydraulic drive sections, thus the first control signal is interrupted by a solenoid proportional valve, and the second control signal is input to the latter hydraulic drive section. Accordingly, among the flow control valves 15*a* to 15*c*, one for which a second control signal is calculated is controlled on the basis of the second control signal, one for which a second control signals is not calculated is controlled on the basis of first control signals, and one for which both first and second control signals are not produced are not controlled (driven). With the definitions of first control signals and second control signals as explained above, it can be said that MC is control of the flow control valves 15*a* to 15*c* based on second control signals.

Controller

In FIG. 5, the controller 40 has an input interface 91, a central processing unit (CPU) 92 which is a processor, a read-only memory (ROM) 93 and a random-access memory (RAM) 94 which are storage devices, and an output interface 95. The input interface 91 receives inputs of signals from the angle sensors 30 to 32, and the inclination angle sensor 33 constituting the work-implement-posture sensor 50, and signals from the target-surface setting device 51 which is a device for setting the target surface 700, and the input interface 91 converts the signals into forms on which the CPU 92 can perform calculation. The ROM 93 is a recoding medium on which a control program for executing MG including processes according to flowcharts mentioned below, various types of information required for execution of the flowcharts, and the like are stored, and the CPU 92 performs predetermined calculation processing on signals taken in from the input interface 91, the ROM 93 and the RAM 94 in accordance with the control program stored on the ROM 93. The output interface 95 can actuate the notification device 53 by creating a signal for output depending on a result of calculation at the CPU 92, and outputting the signal to the notification device 53.

Note that although the controller 40 in FIG. 5 includes semiconductor memories, which are the ROM 93 and the RAM 94, as storage devices, any storage device can replace them, and for example the controller 40 may include a magnetic storage device such as a hard disk drive.

Figure 6:
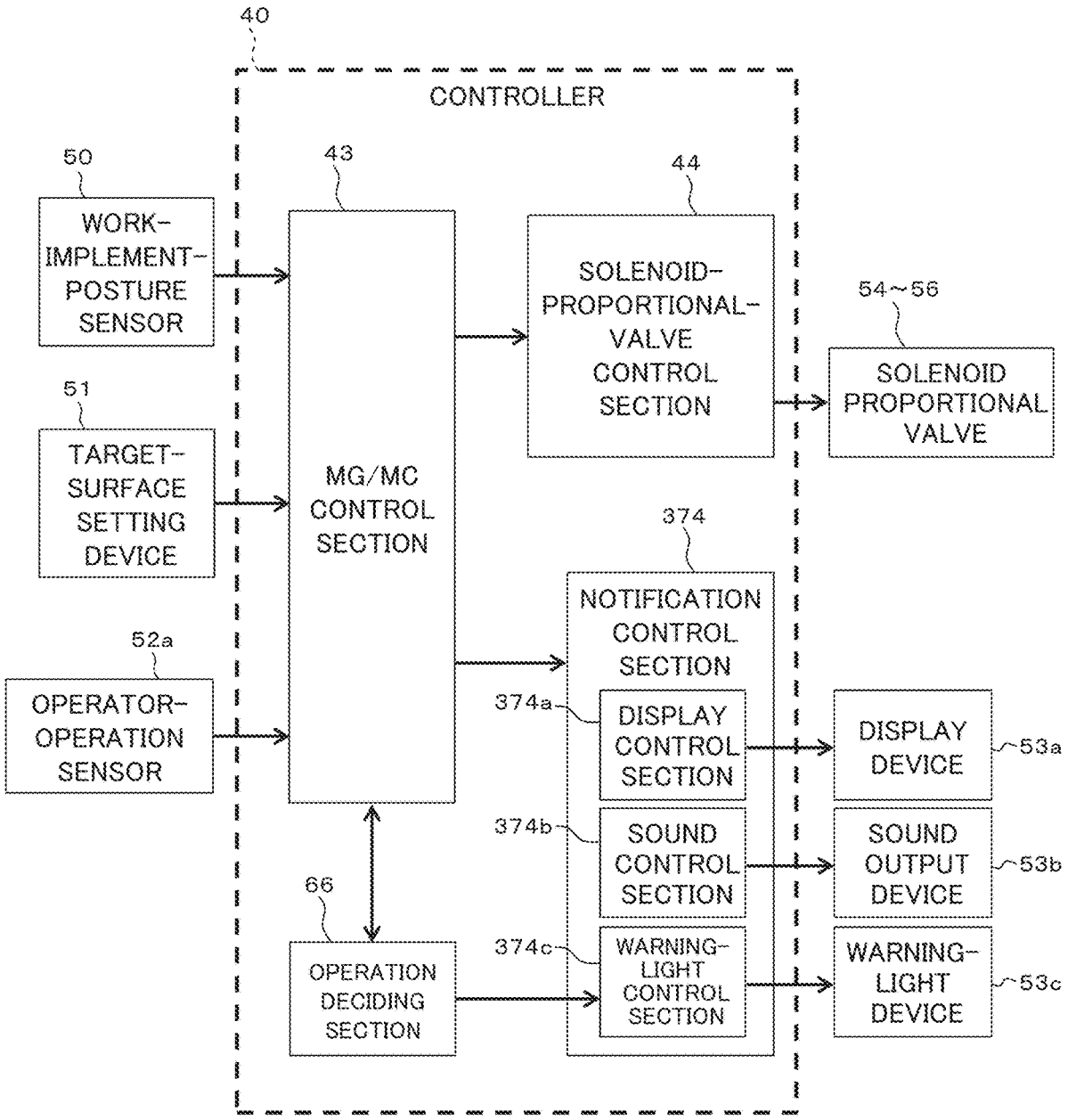
FIG. 6 is a functional block diagram of the controller 40 of the hydraulic excavator.

FIG. 6 is a functional block diagram of the controller 40. The controller 40 includes an MG and MC control section (MG/MC control section) 43, a solenoid-proportional-valve control section 44, a notification control section 374 (a display control section 374*a*, a sound control section 374*b* and a warning-light control section 374*c*), and an operation deciding section 66.

MG/MC Control Section 43

Figure 7:
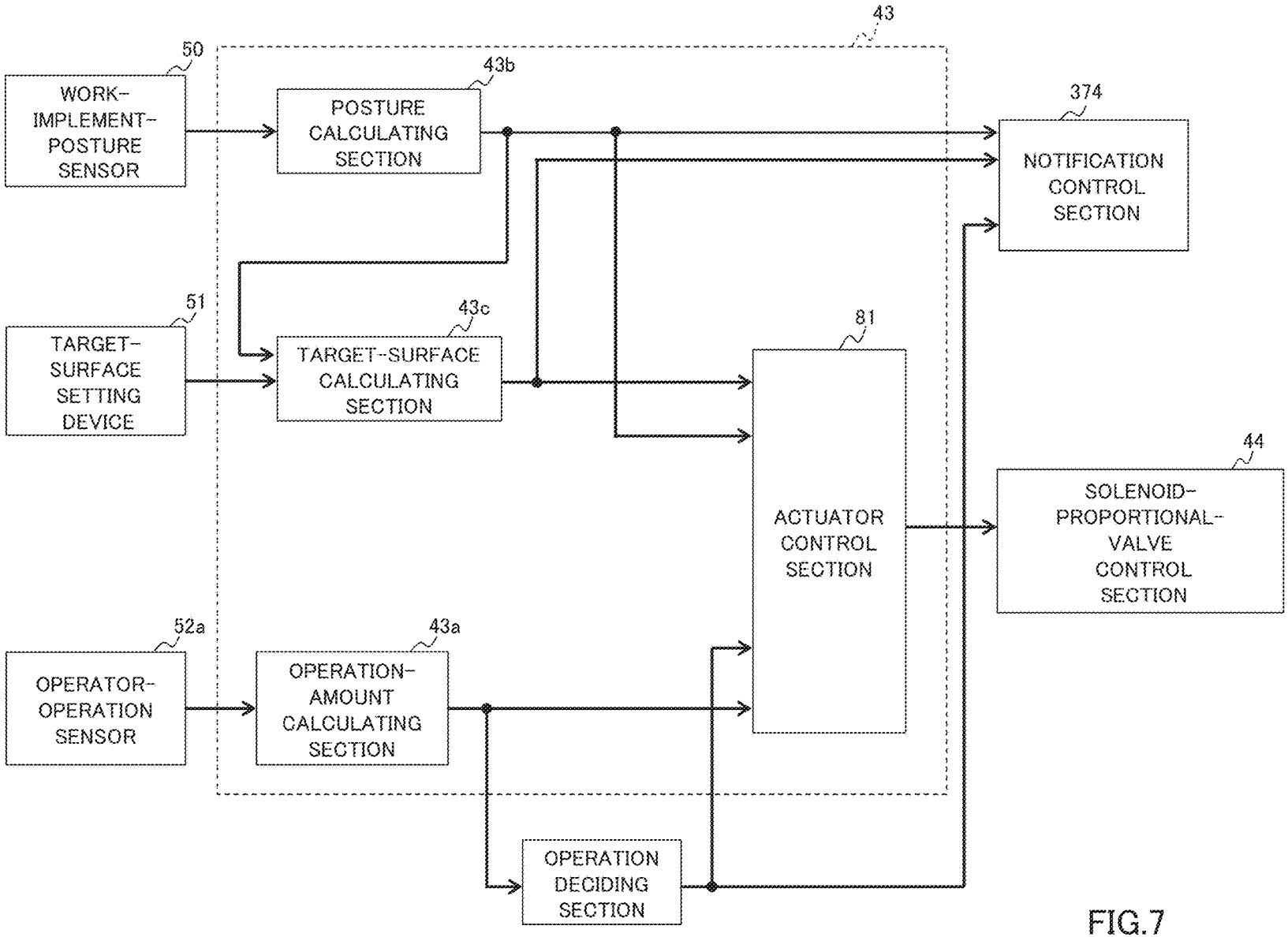
FIG. 7 is a functional block diagram of an MG/MC control section 43 in FIG. 6.

FIG. 7 is a functional block diagram of the MG/MC control section 43 in FIG. 6. The MG/MC control section 43 includes an operation-amount calculating section 43*a*, a posture calculating section 43*b*, a target-surface calculating section 43*c*, an actuator control section 81 and a target surface comparing section 62.

The operation-amount calculating section 43*a* computes operation amounts of the operation devices 45*a*, 45*b* and 46*a* (the operation levers 1*a* and 1*b*) on the basis of an input from the operator-operation sensor 52*a*. Operation amounts of the operation devices 45*a*, 45*b* and 46*a* can be computed from sensing values of the pressure sensors 70, 71 and 72.

Note that computation of operation amounts by the pressure sensors 70, 71 and 72 is merely one example, and for example a position sensor (e.g. a rotary encoder) that senses a rotational displacement of an operation lever of each operation device 45*a*, 45*b* or 46*a* may be used to sense an operation amount of the operation lever. In addition, instead of the configuration in which operation velocities are computed from operation amounts, a configuration in which stroke sensors that sense extension and contraction amounts of the hydraulic cylinders 5, 6 and 7 are attached, and the operation velocities of the cylinders are computed on the basis of sensed temporal changes of the extension and contraction amounts can also be applied.

On the basis of information from the work-implement-posture sensor 50, the posture calculating section 43*b* calculates the posture of the front work implement 1A, and the position of the claw tip of the bucket 10 in a local coordinate system (excavator reference coordinate). As mentioned already, the claw-tip position (Xbk, Zbk) of the bucket 10 can be calculated according to Formula (1) and Formula (2).

The target-surface calculating section 43*c* calculates positional information of the target surface 700 on the basis of information from the target-surface setting device 51, and stores the positional information on the RAM 94. In the present embodiment, as illustrated in FIG. 4, a cross-sectional shape taken from a three-dimensional target surface along a plane on which the work implement 1A moves (an operation plane of the work implement) is used as the target surface 700 (two-dimensional target surface).

Note that although there is one target surface 700 in the example illustrated in FIG. 4, there are a plurality of target surfaces in some cases. In a case in which there are a plurality of target surfaces, methods that can be used include, for example, a method in which one that is the closest to the work implement 1A is set as a target surface, a method in which one positioned below the bucket claw tip is set as a target surface, a method in which one selected as desired is set as a target surface and other methods.

The actuator control section 81 controls at least one of the plurality of hydraulic actuators 5, 6 and 7 in accordance with a predetermined condition, at the time of operation of the operation devices 45*a*, 45*b* and 46*a*. At the time of operation of the operation devices 45*a*, 45*b* and 46*a*, the actuator control section 81 of the present embodiment executes MC of controlling operation of at least one of the boom cylinder 5 (boom 8) and the arm cylinder 6 (arm 9) such that the claw tip (control point) of the bucket 10 is positioned on or above the target surface 700, on the basis of: the position of the target surface 700; the posture of the front work implement 1A, and the position of the claw tip of the bucket 10; and operation amounts of the operation devices 45*a*, 45*b* and 46*a*. The actuator control section 81 calculates target pilot pressures of the flow control valves 15*a*, 15*b* and 15*c* of the hydraulic cylinders 5, 6 and 7, and outputs the calculated target pilot pressures to the solenoid-proportional-valve control section 44. In addition, the actuator control section 81 switches control contents of MC depending on a decision result input from the operation deciding section 66. Details of MC by the actuator control section 81 for each result of decision by the operation deciding section 66 are mentioned below.

Solenoid-Proportional-Valve Control Section 44

The solenoid-proportional-valve control section 44 calculates a command to each solenoid proportional valve 54 to 56 on the basis of target pilot pressures to be applied to the flow control valves 15*a*, 15*b* and 15*c* output from the actuator control section 81. Note that in a case in which a pilot pressure (first control signal) based on operator operation matches a target pilot pressure computed at the actuator control section 81, the value (command value) of current to be caused to flow through a relevant one of the solenoid proportional valve 54 to 56 becomes zero, and operation of the relevant one of the solenoid proportional valves 54 to 56 is not performed.

Operation Deciding Section 66

The operation deciding section 66 decides operation of the front work implement 1A on the basis of operation amounts of the operation devices 45*a*, 45*b* and 46*a* (operation levers 1*a* and 1*b*) calculated at the operation-amount calculating section 43*a*. The operation deciding section 66 outputs a result of the decision to the actuator control section 81 and the notification control section 374 (the display control section 374*a*, the sound control section 374*b* and the warning-light control section 374*c*). Details of a flow of operation decision by the operation deciding section 66 is mentioned below.

Notification Control Section 374

The display control section 374*a* executes a process of displaying, on the display device 53*a*, a positional relationship among the work implement 1A (the claw tip of the bucket 10), the target surface 700, and the boundary line 650 between the deceleration area 600 and the non-deceleration area 620 on the basis of: postural information of the front work implement 1A, positional information of the claw tip of the bucket 10 and positional information of the target surface 700 that are input from the MG/MC control section 43, and a decision result input from the operation deciding section 66. In addition, the display control section 374*a* also executes a process of changing the position of the boundary line 650 on the display device 53*a* depending on a result of decision by the operation deciding section 66. Details of display control by the display control section 374*a* for each result of decision by the operation deciding section 66 are mentioned below.

The sound control section 374*b* executes a process of controlling ON/OFF of an output of an alarm by the sound output device 53*b* on the basis of: postural information of the front work implement 1A, positional information of the claw tip of the bucket 10 and positional information of the target surface 700 that are input from the MG/MC control section 43, and a decision result input from the operation deciding section 66. Details of sound output control by the sound control section 374*b* for each result of decision by the operation deciding section 66 are mentioned below.

The warning-light control section 374*c* executes a process of controlling ON (turns on)/OFF (turns off) of a warning light by the warning-light device 53*c* on the basis of: postural information of the front work implement 1A, positional information of the claw tip of the bucket 10 and positional information of the target surface 700 that are input from the MG/MC control section 43, and a decision result input from the operation deciding section 66. Details of lighting control by the warning-light control section 374*c* for each result of decision by the operation deciding section 66 are mentioned below.

Flow of Operation Decision by Operation Deciding Section 66

Figure 8:
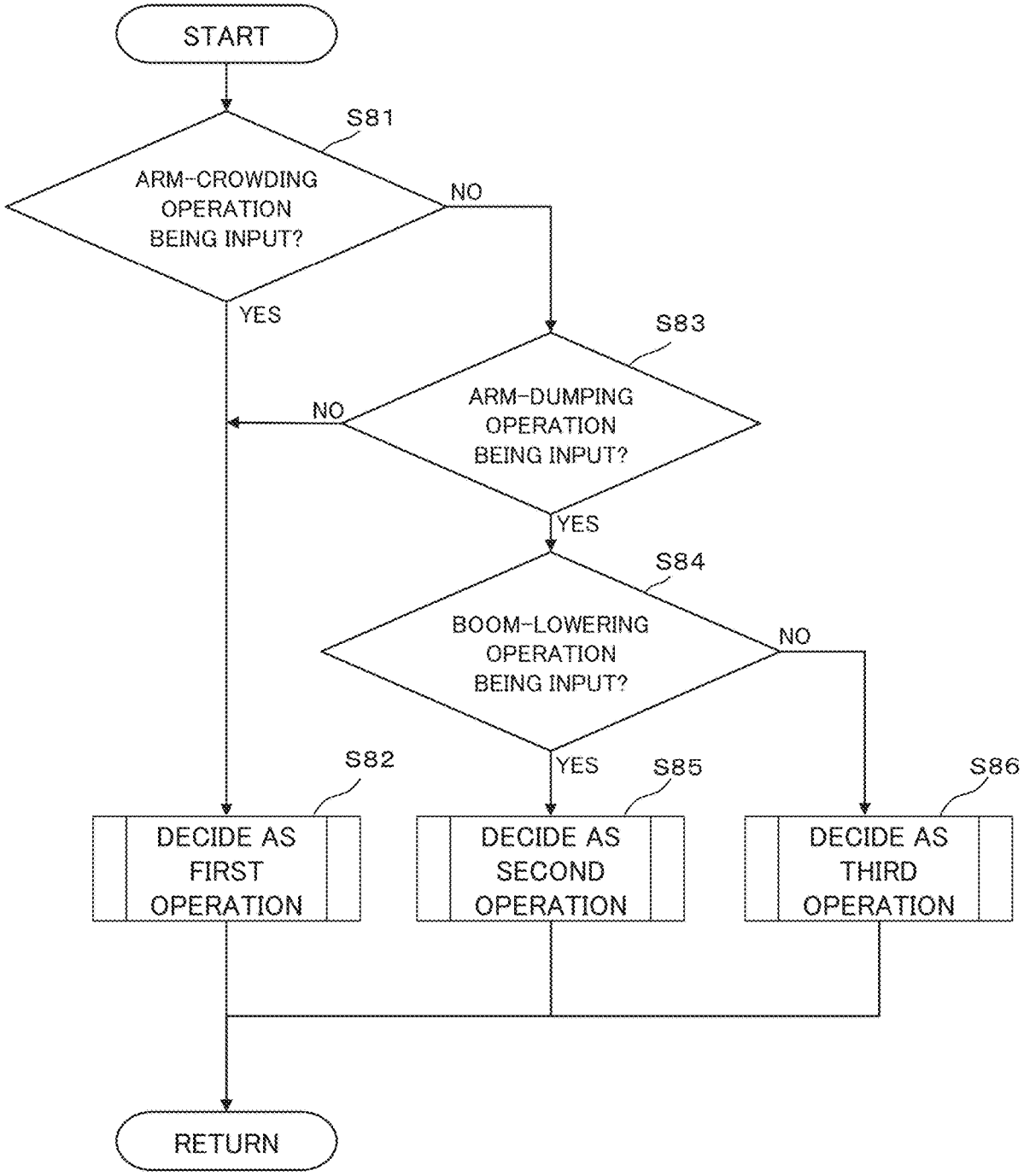
FIG. 8 is a flow of operation decision by an operation deciding section 66.

FIG. 8 is a figure illustrating a flow of operation decision by the operation deciding section 66. The operation deciding section 66 repeats the process in FIG. 8 at predetermined intervals (control cycle). When a control cycle comes and the process is started, at S81, the operation deciding section 66 decides whether or not arm-crowding operation is being input to the operation device 45*b* (i.e. whether or not the pressure sensor 71*a* sensed a pressure which is equal to or higher than a predetermined value). Here, in a case in which an input of arm-crowding operation is sensed, it is decided that the current operation is "first operation." Then, the decision result is output to the actuator control section 81 and the notification control section 374 (the display control section 374*a*, the sound control section 374*b* and the warning-light control section 374*c*), and the operation deciding section 66 waits for the next control cycle (S82). On the other hand, in a case in which an input of arm-crowding operation is not sensed at S81, the process proceeds to S83.

At S83, the operation deciding section 66 decides whether or not arm-dumping operation is being input to the operation device 45*b* (i.e. whether or not the pressure sensor 71*b* sensed a pressure which is equal to or higher than a predetermined value). Here, in a case in which an input of arm-dumping operation is not sensed, it is decided that the current operation is "first operation," and the operation deciding section 66 waits for the next control cycle (S82). On the other hand, in a case in which an input of arm-dumping operation is sensed at S84, the process proceeds to S84.

At S84, the operation deciding section 66 decides whether or not boom-lowering operation is being input to the operation device 45*a* (i.e. whether or not the pressure sensor 70*b* sensed a pressure which is equal to or higher than a predetermined value). Here, in a case in which an input of boom-lowering operation is sensed, it is decided that the current operation is "second operation" which is combined operation of at least arm-dumping and boom-lowering. Then, the decision result is output to the actuator control section 81 and the notification control section 374 (the display control section 374*a*, the sound control section 374*b* and the warning-light control section 374*c*), and the operation deciding section 66 waits for the next control cycle (S85). On the other hand, in a case in which an input of boom-lowering operation is not sensed at S84, the process proceeds to S86, and it is decided that the current operation is "third operation" in which at least arm-dumping (n.b. excluding boom-lowering) is performed. Then, the decision result is output to the actuator control section 81 and the notification control section 374 (the display control section 374*a*, the sound control section 374*b* and the warning-light control section 374*c*), and the operation deciding section 66 waits for the next control cycle (S86).

Meanwhile, as mentioned already, the actuator control section 81 and the notification control section 374 (the display control section 374*a*, the sound control section 374*b* and the warning-light control section 374*c*) execute different control depending on a result of decision (first operation, second operation or third operation) by the operation deciding section 66. Next, detail of the control are explained.

1.1. Flow of Actuator Control Section 81 at the Time of First Operation

Figure 9:
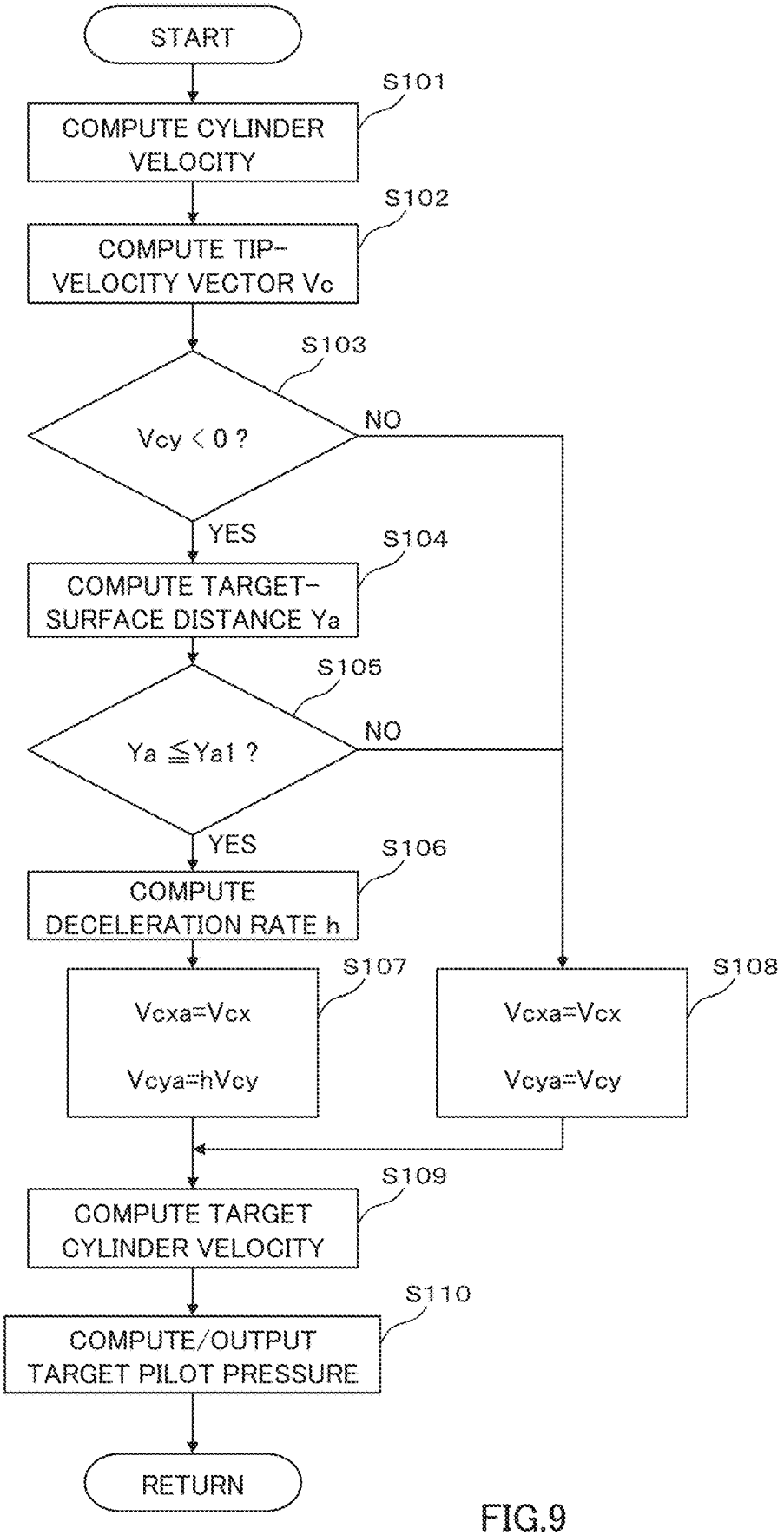
FIG. 9 is a flowchart of control by an actuator control section 81 at the time of first operation (first control).

FIG. 9 is a flowchart of control by the actuator control section 81 at the time of the first operation (first control). The actuator control section 81 starts the process in FIG. 9 when the operation devices 45*a*, 45*b* and 46*a* are operated by an operator.

At S101, the actuator control section 81 calculates operation velocities (cylinder velocities) of the hydraulic cylinders 5, 6 and 7 on the basis of operation amounts calculated at the operation-amount calculating section 43*a*.

At S102, the actuator control section 81 calculates the velocity vector (tip velocity vector) Vc at the bucket tip (claw tip) produced by operator operation, on the basis of the operation velocities of the hydraulic cylinders 5, 6 and 7 calculated at S101, and the posture of the work implement 1A calculated at the posture calculating section 43*b*. Note that in this document, a component of the tip velocity vector Vc horizontal relative to the target surface 700 is defined as Vcx, and a component thereof vertical relative to the target surface 700 is defined as Vcy.

Figure 11:
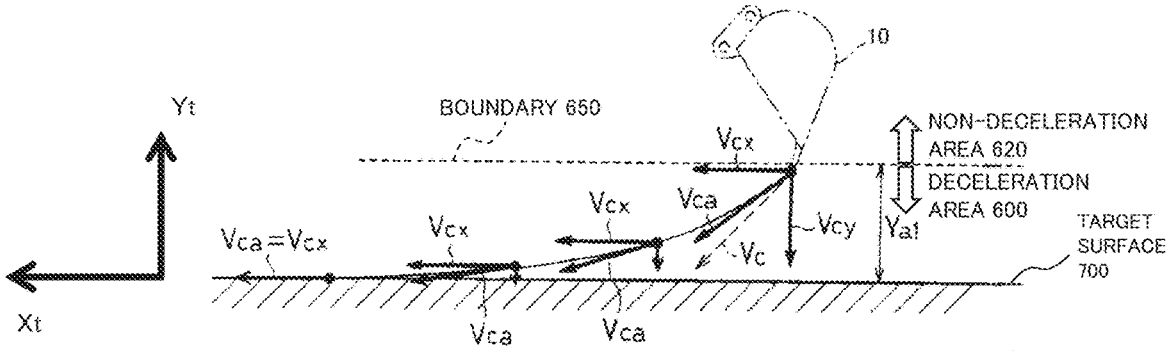
FIG. 11 is a figure illustrating one example of the locus of the tip of a bucket 10 when the tip of the bucket 10 is machine-controlled as indicated by a corrected target velocity vector Vca.

In the present embodiment, an Xt-Yt coordinate system defined by the Xt axis set on the target surface 700 and the Yt axis having its positive direction in the normal direction of the target surface 700 is set as illustrated in FIG. 11, and the claw-tip velocity vector Vc, the target velocity vector Vca mentioned below, and the like are defined in this Xt-Yt coordinate system. In addition, coordinate values in coordinate systems (e.g. the X-Y coordinate system) other than the Xt-Yt coordinate system are used by being converted to coordinates in the Xt-Yt coordinate system as necessary. Note that the position of the origin of the X-Y coordinate system illustrated in FIG. 11 is merely one example, and for example the intersection between the target surface 700 and a vertical line drawn from the claw tip of the bucket 10 taking a certain posture to the target surface 700 may be defined as the origin, and another point may be defined as the origin.

At S103, the actuator control section 81 decides whether or not the component Vcy of the tip velocity vector Vc vertical to the target surface 700 computed at S102 is smaller than zero, that is, whether or not the tip velocity vector Vc (vertical component Vcy) points the direction toward the target surface 700. Here, in a case in which it is decided that the vertical component Vcy is smaller than zero (i.e. a case in which it is decided that the vector Vc points the direction toward the target surface 700), the process proceeds to S104. On the other hand, in a case in which it is decided that the vertical component Vcy is equal to or larger than zero (i.e. a case in which it is decided that the vector Vc points the direction away from the target surface 700), the process proceeds to S108.

At S108, the actuator control section 81 sets the target velocity vector Vca at the bucket tip to the tip velocity vector Vc computed at S102. That is, when a component of the target velocity vector Vca parallel to the target surface 700 is Vcxa, and a component thereof vertical to the target surface 700 is Vcya, Vcxa=Vcx and Vcya=Vcy.

At S104, the actuator control section 81 computes the distance Ya (see FIG. 4) from the bucket tip to the target surface 700 from the position (coordinates) of the claw tip of the bucket 10 calculated at the posture calculating section 43*b*, and the distance of a straight line including the target surface 700 stored on the ROM 93, and the process proceeds to S105.

Figure 10:
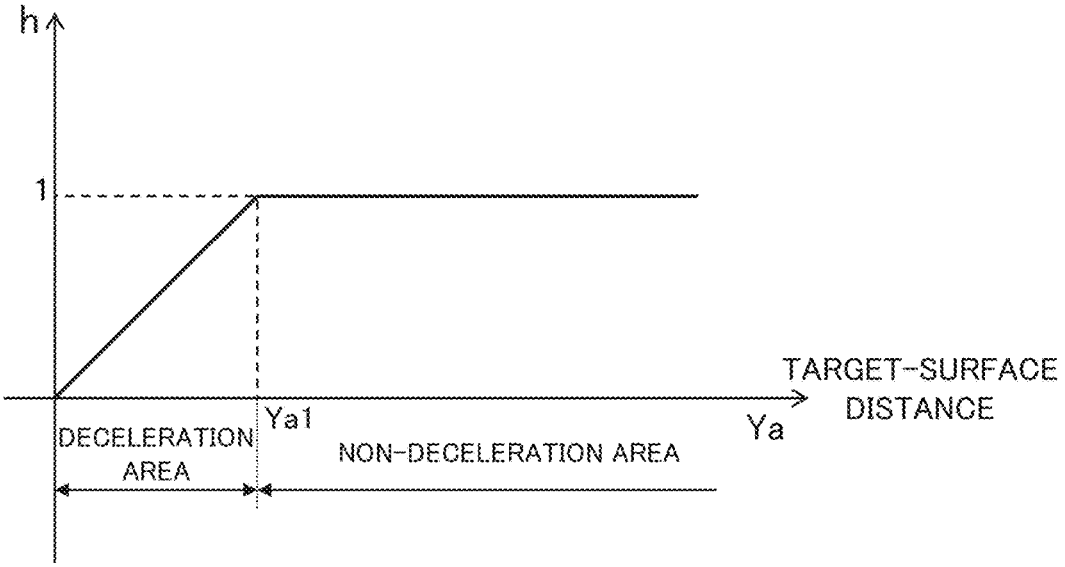
FIG. 10 is a figure illustrating a relationship between a target-surface distance Ya and a deceleration rate h at the time of first operation.

At S105, the actuator control section 81 decides whether or not the target-surface distance Ya computed at S104 is equal to or shorter than Ya1. Ya1 is the distance from the target surface 700 to the boundary line 650 at the time of the first operation as illustrated in FIG. 10 and FIG. 11, and also the height of the deceleration area 600 at the time of the first operation. Accordingly, that the target-surface distance Ya is equal to or shorter than Ya1 means that the claw tip is in the deceleration area 600, and that the target-surface distance Ya is longer than Ya1 means that the claw tip is in the non-deceleration area 620. In addition, the value of Ya1 differs depending on results of decision by the operation deciding section 66 in some cases. In a case in which Ya is equal to or shorter than Ya1 at S104, the process proceeds to S106, and in a case in which Ya is longer than Ya1, the process proceeds to S108.

At S106, the actuator control section 81 computes the deceleration rate h of the component Vcy of the velocity vector at the bucket tip, the component being vertical to the target surface 700, on the basis of Ya computed at S104 and the graph in FIG. 10. The deceleration rate h is a value equal to or larger than 0 and equal to or smaller than 1 and is preset for each target-surface distance Ya. In the present embodiment, as illustrated in FIG. 10, in a range of the target-surface distance Ya that exceeds the predetermined value Ya1, the deceleration rate h is set such that the deceleration rate h is kept at 1, and in a range of the target-surface distance Ya that is equal to or shorter than Ya1, the deceleration rate h is set such that the deceleration rate h decreases also as the distance Ya decreases. Although in the example illustrated in FIG. 10, the deceleration rate h decreases linearly as the target-surface distance Ya decreases, the deceleration rate h can be changed in various manners including those illustrated in FIGS. 18 and 23 that define the deceleration rate h in second control and third control mentioned below as long as the deceleration rate h decreases from 1 to zero as the target-surface distance Ya decreases. After computing the deceleration rate h, the actuator control section 81 proceeds to S107.

At S107, the actuator control section 81 sets the component Vcxa of the target velocity vector Vca at the bucket tip, the component being parallel to the target surface 700, to Vcx (i.e. Vcxa=Vcx). Then, the actuator control section 81 sets the value (hVcy) obtained by multiplying the vertical component Vcy of the tip velocity vector Vc with the deceleration rate h computed at S106 to the vertical component Vcya of the target velocity vector Vca at the bucket tip (i.e. Vcya=hVcy). After the setting of the target velocity vector Vca is completed, the process proceeds to S109.

At S109, the actuator control section 81 calculates target velocities of the hydraulic cylinders 5, 6 and 7 on the basis of the target velocity vector Vca (Vcxa, Vcya) determined at S107 or S108. At this time, if software is designed such that MC of converting the tip velocity vector Vc to the target velocity vector Vca by a combination of boom raising and deceleration of arm crowding is performed, the cylinder velocity of the boom cylinder 5 in the extension direction, and the cylinder velocity of the arm cylinder 6 in the extension direction are calculated.

At S110, the actuator control section 81 calculates target pilot pressures to be applied to the flow control valves 15*a*, 15*b* and 15*c* of the hydraulic cylinders 5, 6 and 7 on the basis of the target velocity of the cylinders 5, 6 and 7 computed at S109, and outputs the target pilot pressures to be applied to the flow control valves 15*a* and 15*b* and 15*c* of the hydraulic cylinders 5, 6 and 7 to the solenoid-proportional-valve control section 44.

The solenoid-proportional-valve control section 44 controls the solenoid proportional valves 54, 55 and 56 such that the target pilot pressures act on the flow control valves 15*a*, 15*b* and 15*c* of the hydraulic cylinders 5, 6 and 7, thus excavation by the work implement 1A is performed. For example, in a case in which an operator operates the operation device 45*b* to perform horizontal excavation by arm-crowding operation, the solenoid proportional valve 55*c* is controlled such that the tip of the bucket 10 does not go into the target surface 700, and the boom-8-raising operation and/or arm-crowding deceleration operation is/are performed automatically.

FIG. 11 is a figure illustrating one example of the locus of the tip of a bucket 10 when the tip of the bucket 10 is machine-controlled as indicated by a corrected target velocity vector Vca like the one explained above. Assuming that the target velocity vector Vc constantly points at a diagonally downward direction, its parallel component Vcx remains constant, and the vertical component Vcy decreases as the tip of the bucket 10 comes closer to the target surface 700 (as the distance Ya decreases). Since the corrected target velocity vector Vca is a synthetic vector of those components, its locus forms a curve that becomes parallel to the target surface 700 as the tip of the bucket 10 comes closer to the target surface 700 as illustrated in FIG. 11. In addition, since Ya=0 and h=0 as illustrated in FIG. 10 in the present embodiment, the target velocity vector Vca on the target surface 700 matches the parallel component Vcx.

Note that operation executed as MC is not limited to automatic control of performing boom-raising operation and arm-crowding deceleration operation that are explained, and for example, control of pivoting the bucket 10 automatically and keeping the angle formed between the target surface 700 and a bottom portion of the bucket 10 constant may be executed.

Figure 12:
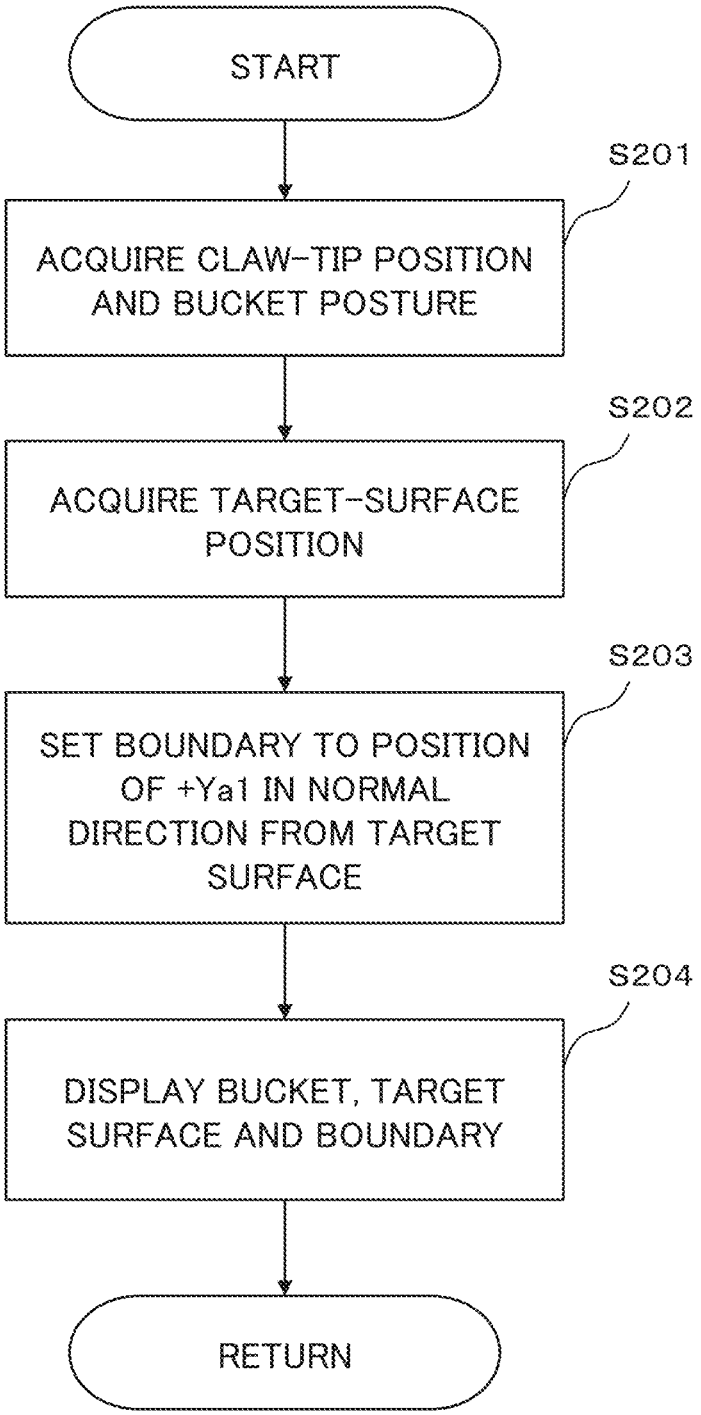
FIG. 12 is a flowchart of control by a display control section 374*a* at the time of the first operation (first control).

1.2. Flow of Display Control Section 374*a* at the Time of First Operation FIG. 12 is a flowchart of control by the display control section 374*a* at the time of the first operation (first control). The display control section 374*a* starts the process of FIG. 12 in a predetermined control cycle.

At S201, the display control section 374*a* acquires the position of the claw tip and posture of the bucket 10 from the posture calculating section 43*b*.

At S202, the display control section 374*a* acquires positional information of the target surface 700 from the target-surface calculating section 43*c*.

At S203, the display control section 374*a* sets the position of the boundary line 650 to the position of +Ya1 in the normal direction of the target surface 700 from the position of the target surface 700 acquired at S202. The boundary line 650 of the present embodiment is offset from the target surface 700 by Ya1 in the positive direction along the Yt axis. Ya1, which is the offset amount, matches the value (Ya1) used by the actuator control section 81 in the decision at S105, and may change depending on a result of decision by the operation deciding section 66.

At S204, the display control section 374*a* displays, on the screen of the display device 53*a*, a positional relationship among the boundary line 650, the target surface 700 and the bucket 10 on the basis of the information acquired at S201, S202 and S203.

FIG. 13 is a figure illustrating one example of the configuration diagram of the notification device 53. The notification device 53 illustrated in this figure includes the display device 53*a*, the sound output device 53*b* and the warning-light device 53*c*. A positional relationship among the boundary line 650, the target surface 700 and the bucket 10 is displayed on the display screen of the display device 53*a*. The distance between the target surface 700 and the boundary line 650 in the case illustrated in this figure is Ya1 [m]. By displaying a positional relationship between the bucket 10 and the boundary line 650 of the deceleration area 600 on the display device 53*a* in this manner, an operator can perform withdrawing operation while grasping a positional relationship between the bucket 10 and the deceleration area 600 displayed on the display device 53*a*. Accordingly, the length of time during which the work implement 1A passes, while performing withdrawing work, through the deceleration area 600 in which machine control is executed can be reduced, and the work efficiency can be improved.

Figure 14:
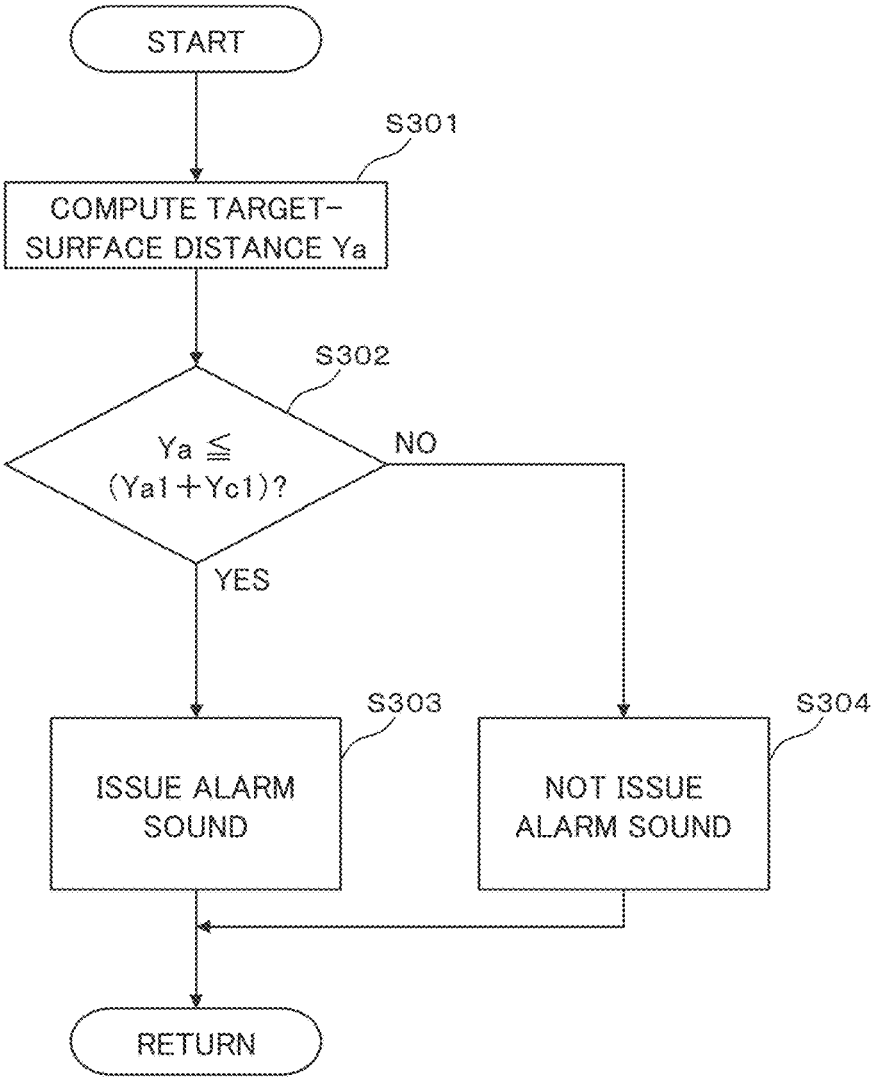
FIG. 14 is a flowchart of control by a sound control section 374*b* at the time of the first operation (first control).

1.3. Flow of Sound Control Section 374*b* at the Time of First Operation FIG. 14 is a flowchart of control by the sound control section 374*b* at the time of the first operation (first control). The sound control section 374*b* starts the process of FIG. 14 in a predetermined control cycle.

At S301, the sound control section 374*b* computes the distance Ya (see FIG. 4) from the bucket tip to the target surface 700, from the position (coordinates) of the claw tip of the bucket 10 calculated at the posture calculating section 43*b*, and the distance of a straight line including the target surface 700 stored on the ROM 93, and the process proceeds to S302.

Figure 15:
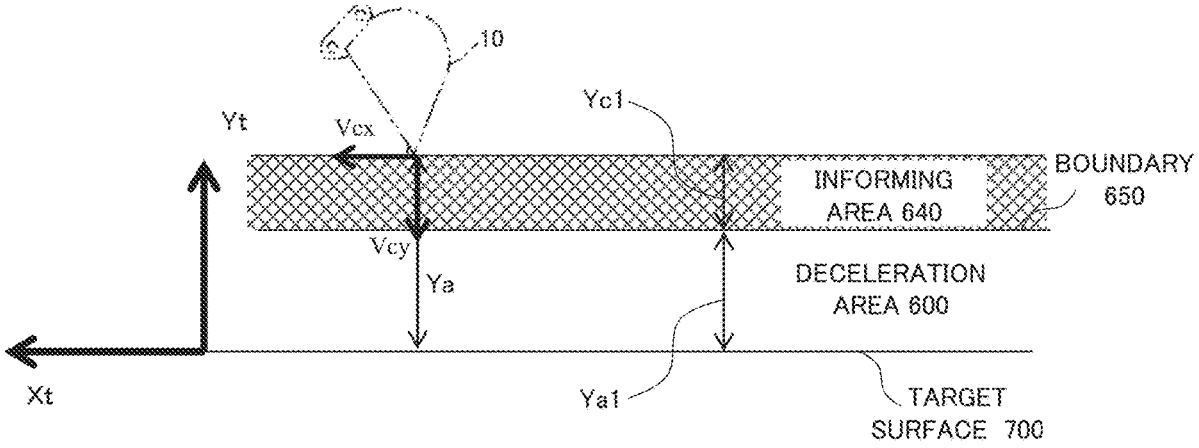
FIG. 15 is a figure for explaining an informing area 640.

At S302, the sound control section 374*b* decides whether or not the target-surface distance Ya computed at S301 is equal to or shorter than the value obtained by adding the height Yc1 (see FIG. 15) of an informing area 640 to the height Ya1 of the deceleration area 600. FIG. 15 is a figure for explaining the informing area 640. The informing area 640 is an area with the height Yc1 set above and adjacent to the deceleration area 600. Yc1 is an offset amount in the upward direction from the boundary line 650. In the present embodiment, in a case in which the claw tip of the bucket 10 goes into the informing area 640, a sound (alarm) is produced, and an operator is notified that the tip of the bucket 10 is about to go into the deceleration area 600. In a case in which it is decided at S302 that the target-surface distance Ya is equal to or shorter than Ya1+Yc1, the process proceeds to S303, and in a case in which it is decided that the target-surface distance Ya exceeds Ya1+Yc1, the process proceeds to S304.

At S303, the sound control section 374*b* issues an alarm from the sound output device 53*b* (see FIG. 6).

At S304, the sound control section 374*b* waits until the next control-start time without issuing an alarm from the sound output device 53*b*.

By producing an alarm when a tip portion of the bucket 10 has gone into the informing area 640 in this manner, an operator can recognize that the tip portion of the bucket 10 is about to go into the deceleration area 600. Thereby, the work implement 1A can be operated efficiently such that the tip portion of the bucket 10 does not go into the deceleration area 600.

1.4. Flow of Warning-Light Control Section 374*c* at the Time of First Operation The flowchart of the control by the warning-light control section 374*c* at the time of the first operation (first control) is different from the flowchart of the control by the sound control section 374*b* at the time of the first operation (first control) in FIG. 14 in that S303 is changed to "Turn on Warning Light" and S304 is changed to "Turn off Warning Light," and the other steps are the same as those in FIG. 14.

Since the warning light 53*c* (see FIG. 13) is turned on when a tip portion of the bucket 10 has gone into the informing area 640 by configuring the warning-light control section 374*c* in this manner, an operator can recognize that the tip portion of the bucket 10 is about to go into the deceleration area 600. Thereby, the work implement 1A can be operated efficiently such that the tip portion of the bucket 10 does not go into the deceleration area 600.

2.1. Flow of Actuator Control Section 81 at the Time of the Second Operation Next, control by the actuator control section 81 and the notification control section 374 at the time of second operation (arm-dumping+boom-lowering) is explained.

Figure 16:
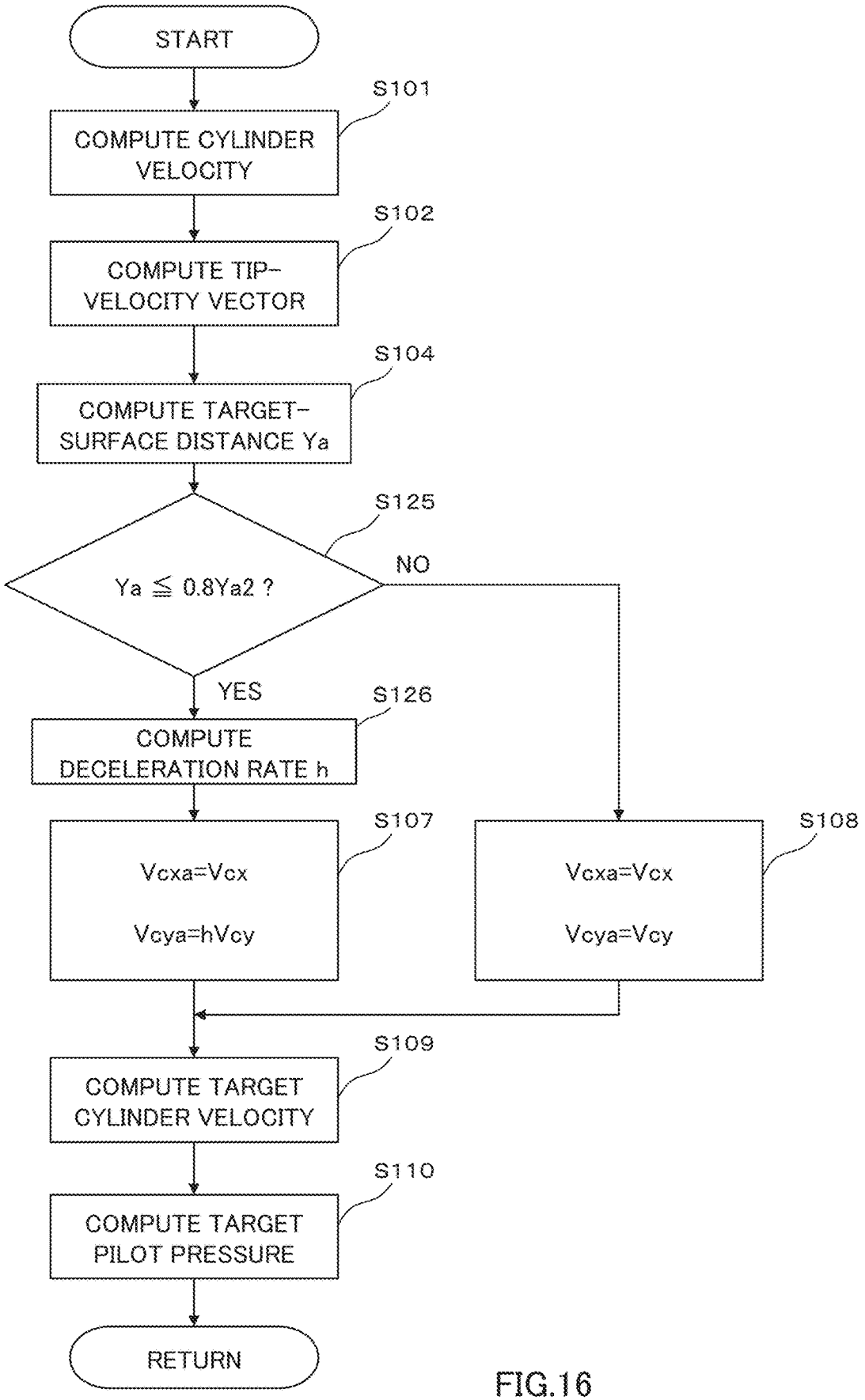
FIG. 16 is a flowchart of control by the actuator control section 81 at the time of second operation (second control).

FIG. 16 is a flowchart of control by the actuator control section 81 at the time of second operation (second control). Note that steps that are the same as those in the flow at the time of the first operation illustrated in FIG. 9 are given the same reference signs, and explanations thereof are omitted. This applies also to the following figures.

Figure 17:
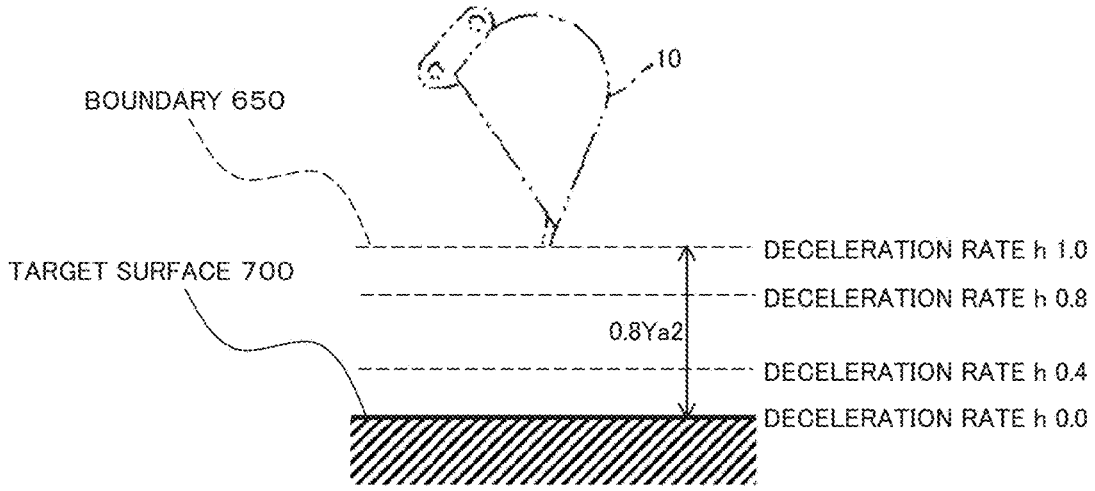
FIG. 17 is a figure illustrating a relationship between the target-surface distance Ya and the deceleration rate h at the time of the second operation.
Figure 18:
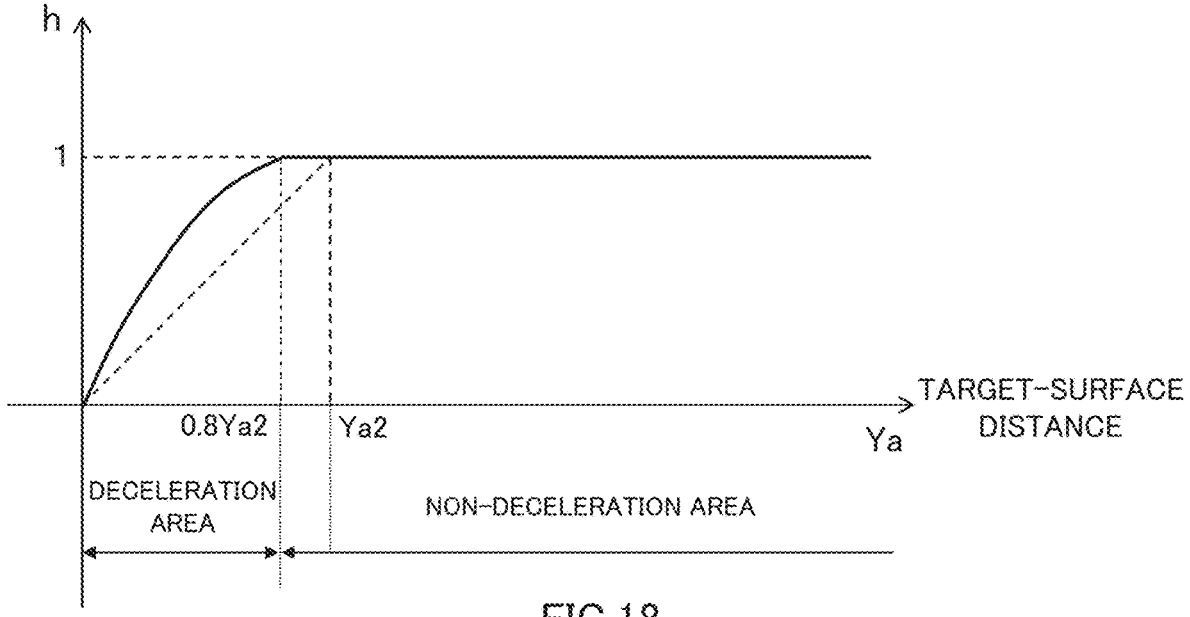
FIG. 18 is a figure illustrating a relationship between the target-surface distance Ya and the deceleration rate h at the time of the second operation.

At S125, the actuator control section 81 decides whether or not the target-surface distance Ya computed at S104 is equal to or shorter than 0.8Ya2. 0.8Ya2 is the distance from the target surface 700 to the boundary line 650 at the time of the second operation as illustrated in FIGS. 17 and 18, and also the height of the deceleration area 600 at the time of the second operation. In addition, the value of 0.8Ya2 differs depending on results of decision by the operation deciding section 66 in some cases. In a case in which Ya is equal to or shorter than 0.8Ya2 at S104, the process proceeds to S126, and in a case in which Ya is longer than 0.8Ya2, the process proceeds to S108.

At S126, the actuator control section 81 computes the deceleration rate h of the component Vcy of the velocity vector at the bucket tip, the component being vertical to the target surface 700, on the basis of Ya computed at S104 and the graph in FIG. 18. FIG. 17 and FIG. 18 are figures illustrating a relationship between the target-surface distance Ya and the deceleration rate h at the time of the second operation. FIG. 17 illustrates part of the relationship illustrated in FIG. 18 in a rewritten tabular format. In the present embodiment, as illustrated in FIG. 18, in a range of the target-surface distance Ya that exceeds the predetermined value 0.8Ya2, the deceleration rate h is set so as to kept at 1, and in a range of the target-surface distance Ya that is equal to or shorter than 0.8Ya2, the deceleration rate h is set so as to decrease also as the distance Ya decreases. In the example illustrated in FIG. 18, the deceleration rate h decreases curvilinearly as the target-surface distance Ya decreases, and the deceleration starts from the position where the target-surface distance Ya is shorter as compared to the corresponding position in third operation in FIG. 23 mentioned below. This is for the purpose of enabling more efficient withdrawing operation by preventing deceleration of the velocity vector in a range where the target-surface distance Ya exceeds 0.8Ya2 at the time of arm-dumping+boom-lowering (at the time of the second operation). Note that the relationship between the target-surface distance Ya and the deceleration rate h can be changed in various manners as long as the deceleration rate h decreases from 1 to zero as the target-surface distance Ya decreases. Ya2 may be made equal to Ya1. The height 0.8Ya2 of the boundary line 650 from the target surface 700 is shared also by the notification control section 374 during the second operation. After computing the deceleration rate h, the actuator control section 81 proceeds to S107.

2.2. Flow of Display Control Section 374*a* at the Time of Second Operation

Figure 19:
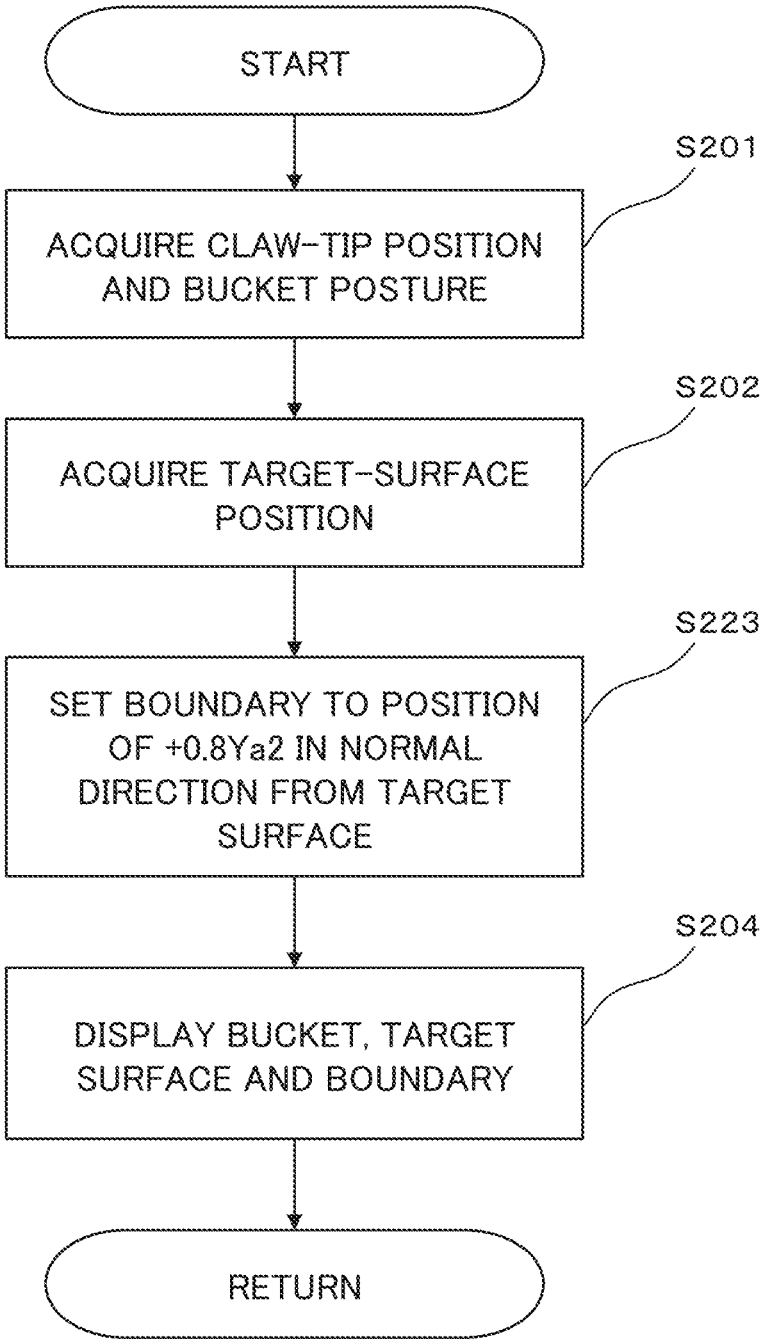
FIG. 19 is a flowchart of control by the display control section 374*a* at the time of the second operation (second control).

FIG. 19 is a flowchart of control by the display control section 374*a* at the time of the second operation (second control).

At S223, the display control section 374*a* sets the position of the boundary line 650 to the position of +0.8Ya2 in the normal direction of the target surface 700 from the position of the target surface 700 acquired at S202. The boundary line 650 of the present embodiment is offset from the target surface 700 by 0.8Ya2 in the positive direction along the Yt axis. 0.8Ya2, which is the offset amount, matches the value (0.8Ya2) used by the actuator control section 81 in the decision at S125, and may change depending on a result of decision by the operation deciding section 66.

Figure 26:
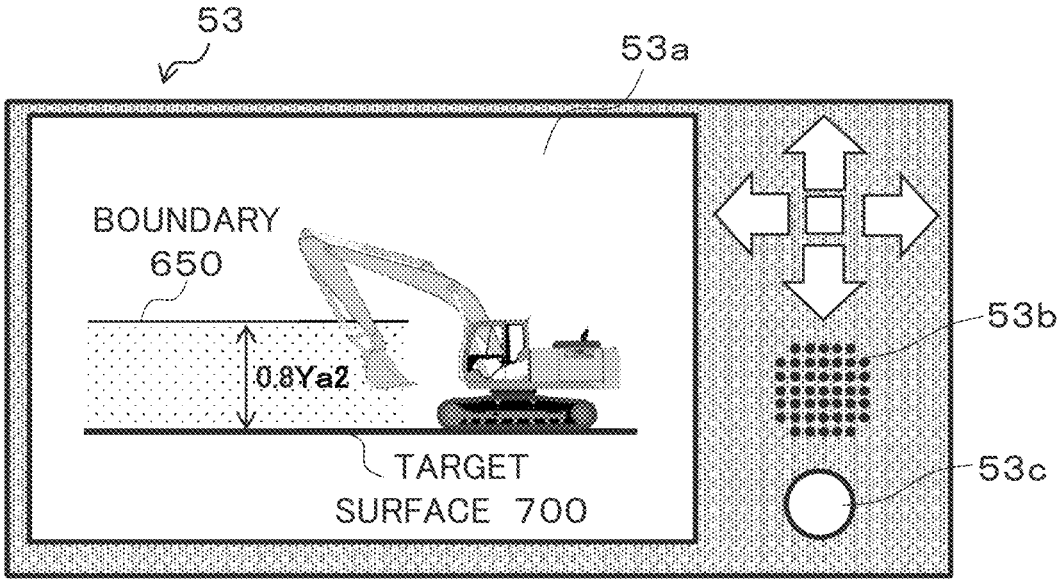
FIG. 26 is a figure illustrating one example of the notification device 53 during the second operation.

FIG. 26 is a figure illustrating one example of the notification device 53 during the second operation. A positional relationship among the boundary line 650, the target surface 700 and the bucket 10 is displayed on the display screen of the display device 53*a*. The distance between the target surface 700 and the boundary line 650 in the case illustrated in this figure is 0.8Ya2 [m]. By displaying a positional relationship between the bucket 10 and the boundary line 650 of the deceleration area 600 on the display device 53*a* in this manner, an operator can perform withdrawing operation while grasping a positional relationship between the bucket 10 and the deceleration area 600 even if the position of the boundary line 650 changes depending on operation of the front work implement 1A. Accordingly, the length of time during which the work implement 1A passes, while performing withdrawing work, through the deceleration area 600 in which machine control is executed can be reduced, and the work efficiency can be improved.

2.3. Flow of Sound Control Section 374*b* at the Time of Second Operation

Figure 20:
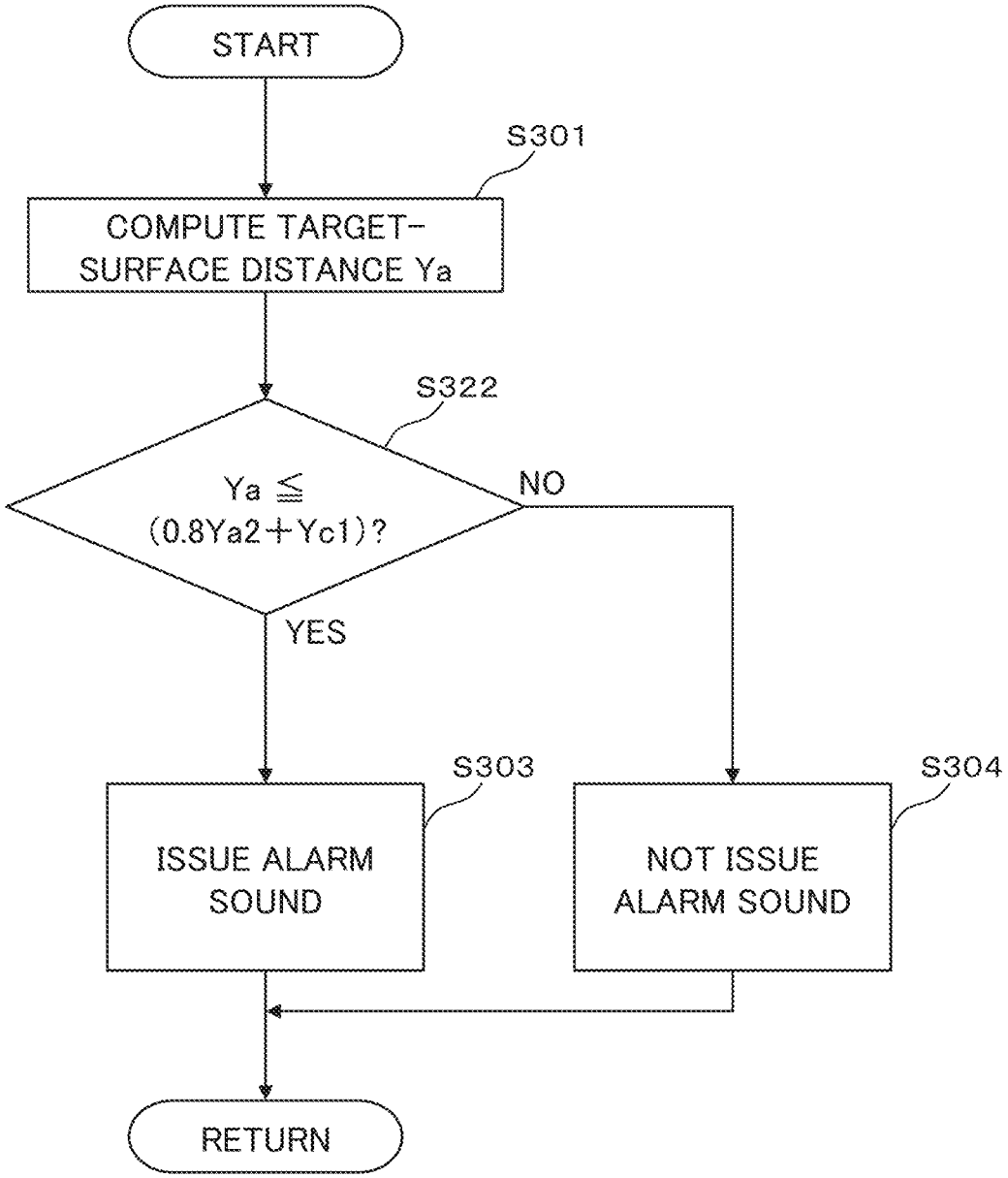
FIG. 20 is a flowchart of control by the sound control section 374*b* at the time of the second operation (second control).

FIG. 20 is a flowchart of control by the sound control section 374*b* at the time of the second operation (second control).

At S322, the sound control section 374*b* decides whether or not the target-surface distance Ya computed at S301 is equal to or shorter than the value obtained by adding the height Yc1 of the informing area 640 to the height 0.8Ya2 of the deceleration area 600. In a case in which it is decided at S322 that the target-surface distance Ya is equal to or shorter than 0.8Ya2+Yc1, the process proceeds to S303, and in a case in which it is decided that the target-surface distance Ya exceeds 0.8Ya2+Yc1, the process proceeds to S304.

2.4. Flow of Warning-Light Control Section 374*c* at the Time of Second Operation The flowchart of the control by the warning-light control section 374*c* at the time of the second operation (second control) is different from the flowchart of the control by the sound control section 374*b* at the time of the second operation (second control) in FIG. 20 in that S303 is changed to "Turn on Warning Light" and S304 is changed to "Turn off Warning Light," and the other steps are the same as those in FIG. 20.

3.1. Flow of Actuator Control Section 81 at the Time of Third Operation

Next, control by the actuator control section 81 and the notification control section 374 at the time of third operation (at the time of only arm-dumping operation) is explained.

Figure 21:
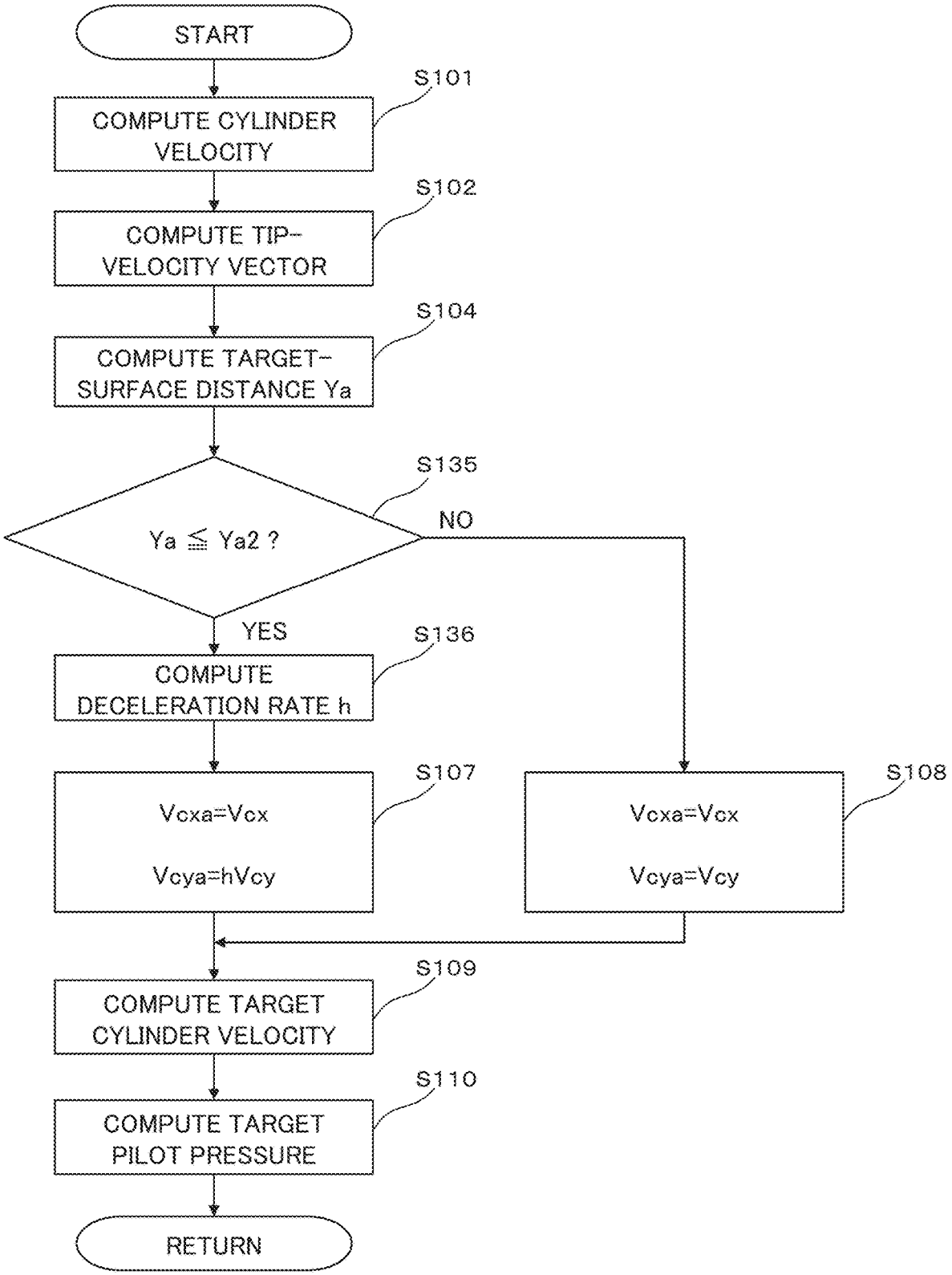
FIG. 21 is a flowchart of control by the actuator control section 81 at the time of third operation (third control).

FIG. 21 is a flowchart of control by the actuator control section 81 at the time of the third operation (third control).

Figure 22:
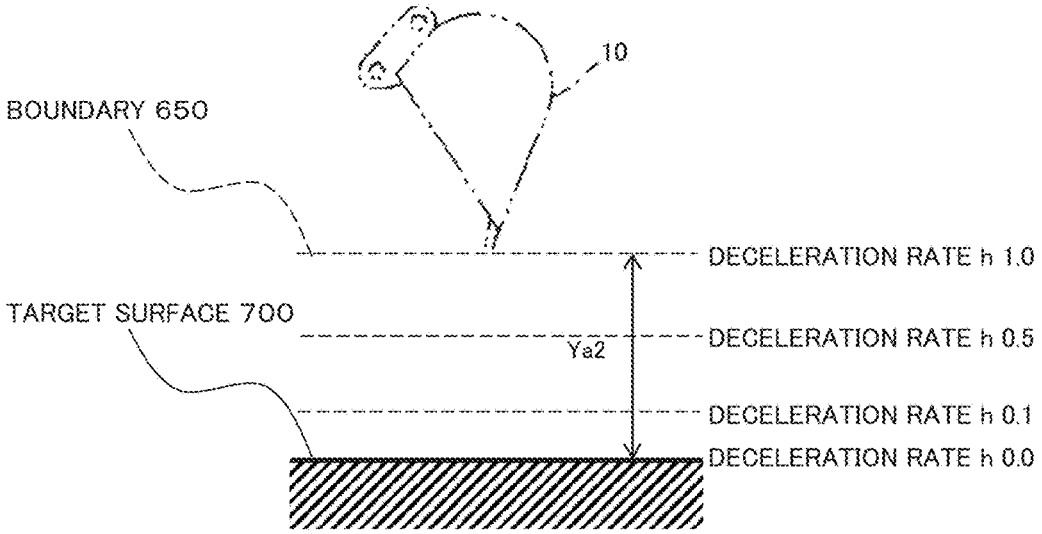
FIG. 22 is a figure illustrating a relationship between the target-surface distance Ya and the deceleration rate h at the time of the third operation.
Figure 23:
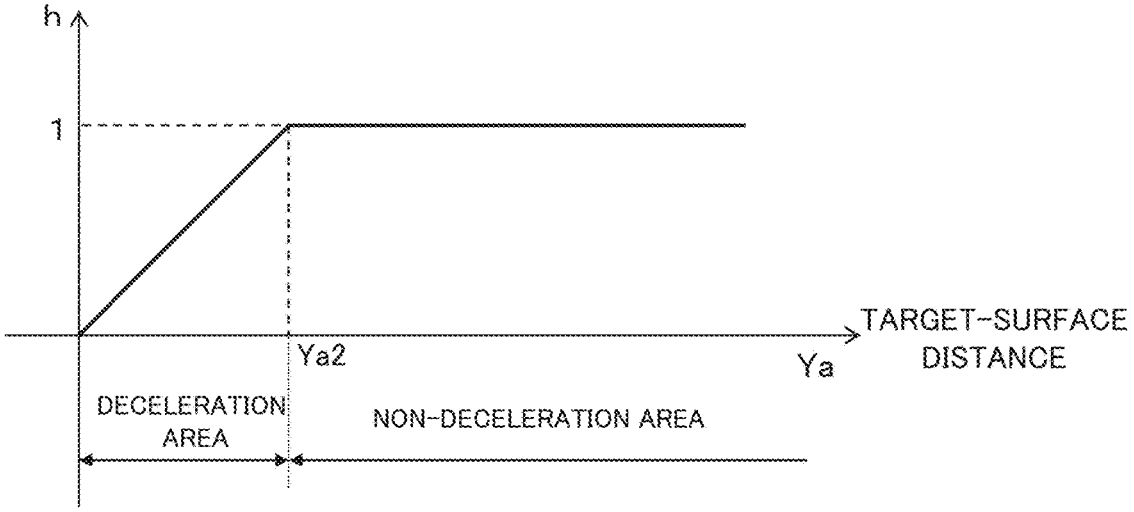
FIG. 23 is a figure illustrating a relationship between the target-surface distance Ya and the deceleration rate h at the time of the third operation.

At S135, the actuator control section 81 decides whether or not the target-surface distance Ya computed at S104 is equal to or shorter than Ya2. Ya2 is the distance from the target surface 700 to the boundary line 650 at the time of the third operation as illustrated in FIGS. 22 and 23, and also the height of the deceleration area 600 at the time of the third operation. In addition, the value of Ya2 differs depending on results of decision by the operation deciding section 66 in some cases. In a case in which Ya is equal to or shorter than Ya2 at S104, the process proceeds to S136, and in a case in which Ya is longer than Ya2, the process proceeds to S108.

At S136, the actuator control section 81 computes the deceleration rate h of the component Vcy of the velocity vector at the bucket tip, the component being vertical to the target surface 700, on the basis of Ya computed at S104 and the graph in FIG. 23. FIG. 22 and FIG. 23 are figures illustrating a relationship between the target-surface distance Ya and the deceleration rate h at the time of the third operation. FIG. 22 illustrates part of the relationship illustrated in FIG. 23 in a rewritten tabular format. In the present embodiment, as illustrated in FIG. 23, in a range of the target-surface distance Ya that exceeds the predetermined value Ya2, the deceleration rate h is set so as to kept at 1, and in a range of the target-surface distance Ya that is equal to or shorter than Ya2, the deceleration rate h is set so as to decrease also as the distance Ya decreases. In the example illustrated in FIG. 23, the deceleration rate h decreases linearly as the target-surface distance Ya decreases, and the deceleration starts from the position where the target-surface distance Ya is longer as compared to the corresponding position in the second operation in FIG. 18. This is for the purpose of starting deceleration of the velocity vector from the position where the target-surface distance Ya is long in order to prevent the tip or the rear end of the bucket from going into the target surface 700 by arm-dumping operation at the time of first withdrawing work mentioned below. Note that the relationship between the target-surface distance Ya and the deceleration rate h can be changed in various manners as long as the deceleration rate h decreases from 1 to zero as the target-surface distance Ya decreases. Ya2 may be made equal to Ya1. The height Ya2 of the boundary line 650 from the target surface 700 is shared also by the notification control section 374 during the third operation. After computing the deceleration rate h, the actuator control section 81 proceeds to S107.

Figure 24:
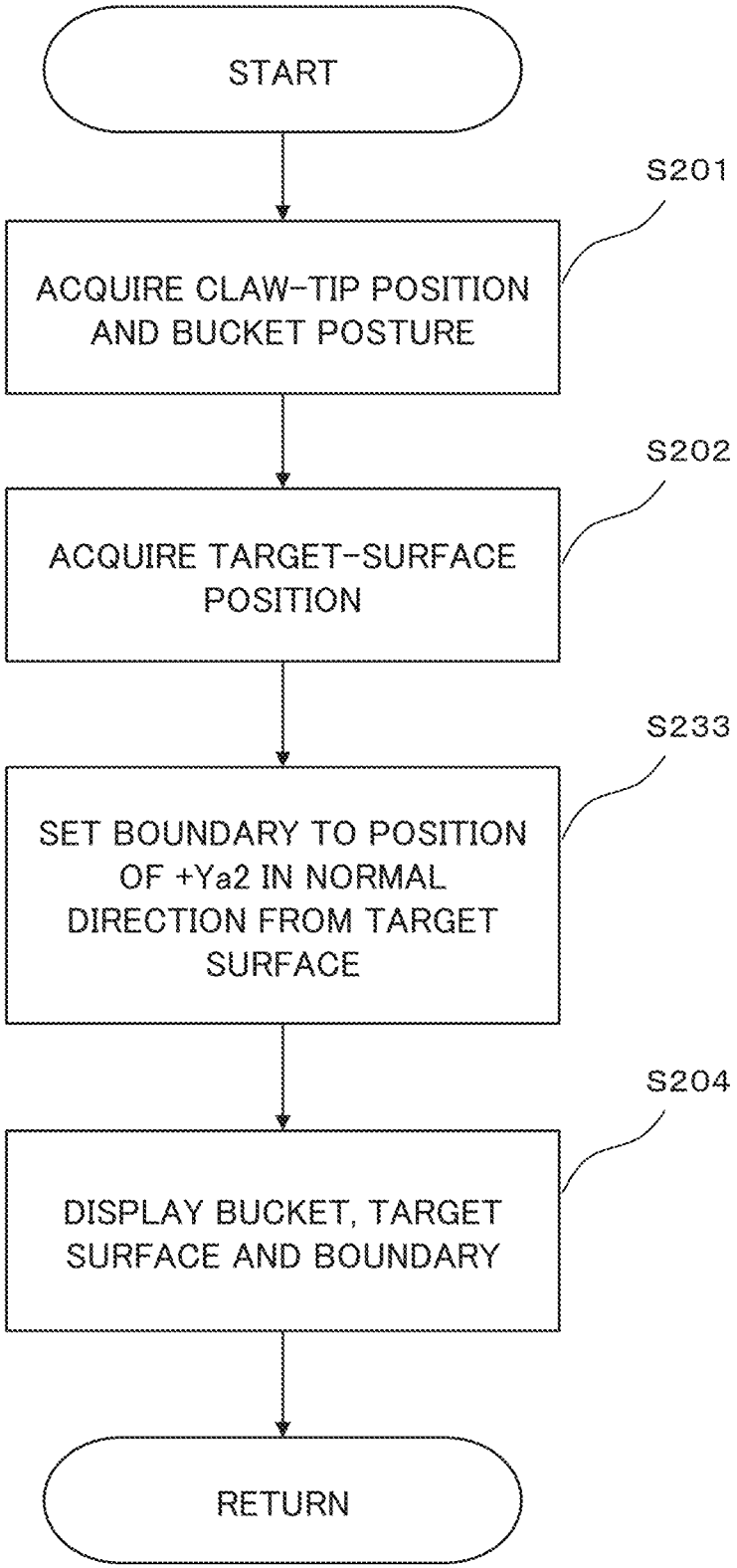
FIG. 24 is a flowchart of control by the display control section 374*a* at the time of the third operation (third control).

3.2. Flow of Display Control Section 374*a* at the Time of Third Operation FIG. 24 is a flowchart of control by the display control section 374*a* at the time of the third operation (third control).

At S233, the display control section 374*a* sets the position of the boundary line 650 to the position of +Ya2 in the normal direction of the target surface 700 from the position of the target surface 700 acquired at S202. The boundary line 650 of the present embodiment is offset from the target surface 700 by Ya2 in the positive direction along the Yt axis. Ya2, which is the offset amount, matches the value (Ya2) used by the actuator control section 81 in the decision at S135, and may change depending on a result of decision by the operation deciding section 66.

Figure 27:
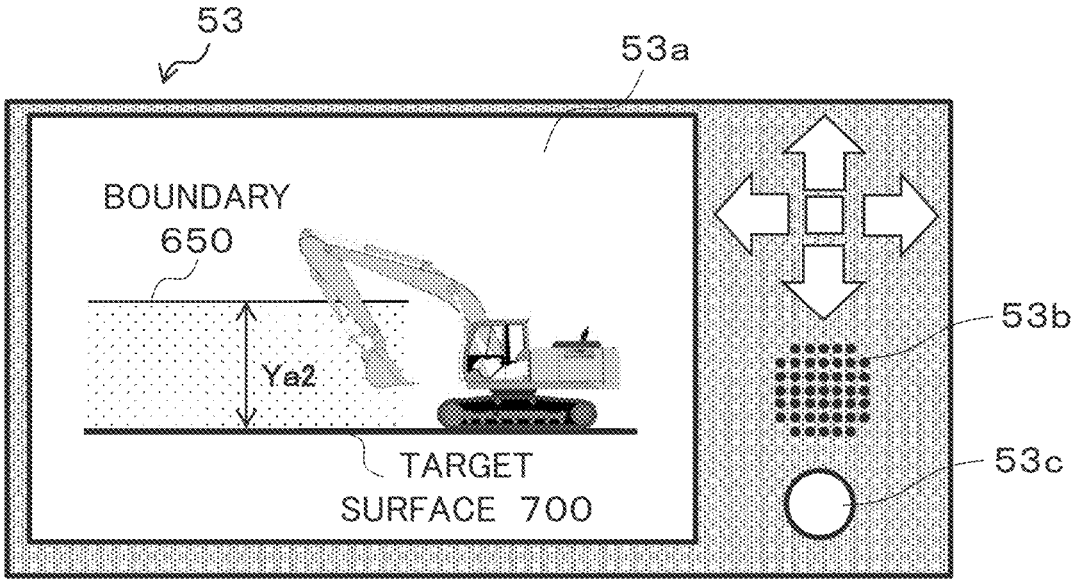
FIG. 27 is a figure illustrating one example of the notification device 53 during the third operation.

FIG. 27 is a figure illustrating one example of the notification device 53 during the third operation. A positional relationship among the boundary line 650, the target surface 700 and the bucket 10 is displayed on the display screen of the display device 53*a*. The distance between the target surface 700 and the boundary line 650 in the case illustrated in this figure is Ya2 [m]. By displaying a positional relationship between the bucket 10 and the boundary line 650 of the deceleration area 600 on the display device 53*a* in this manner, an operator can perform withdrawing operation while grasping a positional relationship between the bucket 10 and the deceleration area 600 even if the position of the boundary line 650 changes depending on operation of the front work implement 1A. Accordingly, the length of time during which the work implement 1A passes, while performing withdrawing work, through the deceleration area 600 in which machine control is executed can be reduced, and the work efficiency can be improved.

Figure 25:
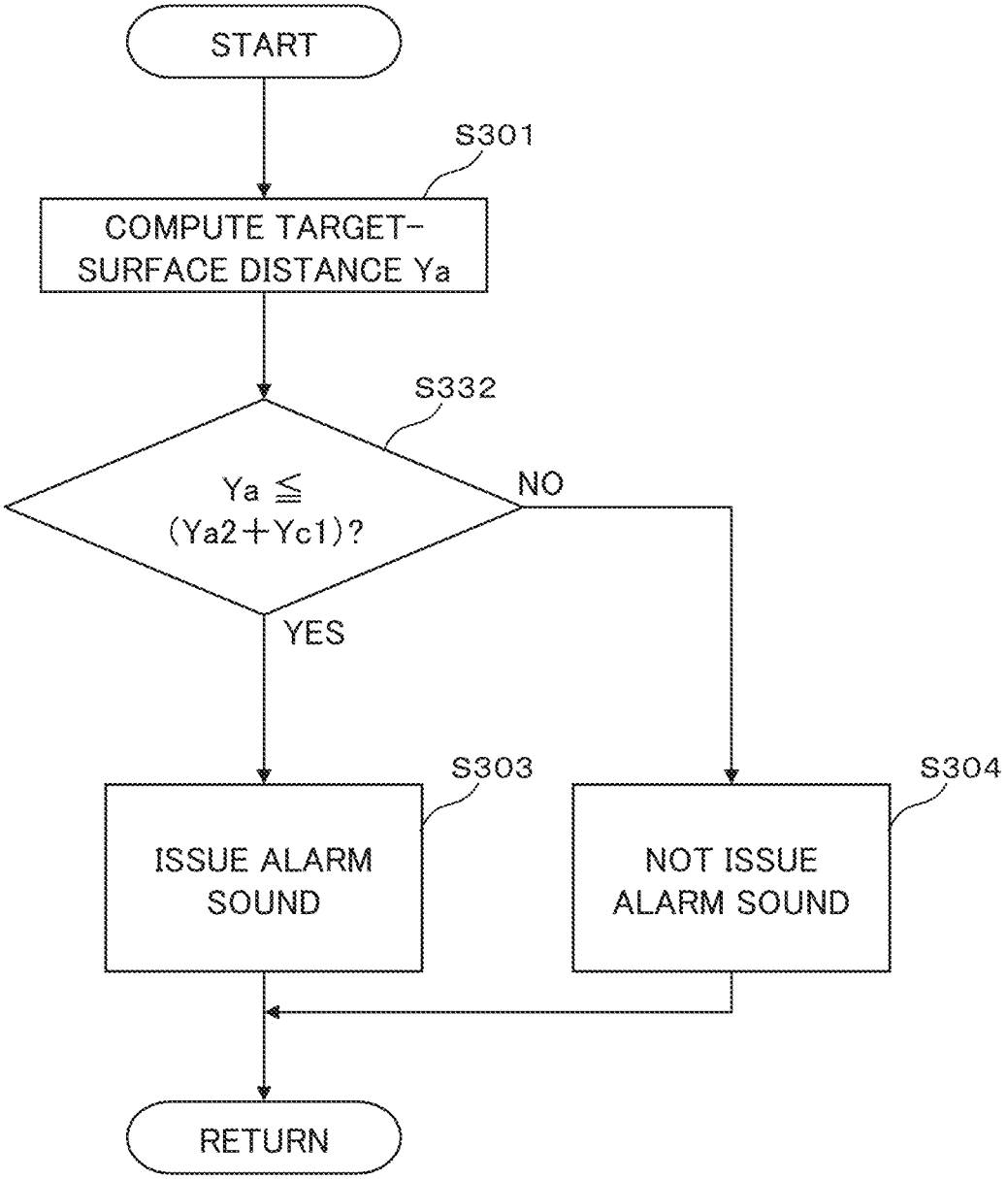
FIG. 25 is a flowchart of control by the sound control section 374*b* at the time of the third operation (third control).

3.3. Flow of Sound Control Section 374*b* at the Time of Third Operation FIG. 25 is a flowchart of control by the sound control section 374*b* at the time of the third operation (third control).

At S332, the sound control section 374*b* decides whether or not the target-surface distance Ya computed at S301 is equal to or shorter than the value obtained by adding the height Yc1 of the informing area 640 to the height Ya2 of the deceleration area 600. In a case in which it is decided at S332 that the target-surface distance Ya is equal to or shorter than Ya2+Yc1, the process proceeds to S303, and in a case in which it is decided that the target-surface distance Ya exceeds Ya2+Yc1, the process proceeds to S304.

3.4. Flow of Warning-Light Control Section 374*c* at the Time of Third Operation The flowchart of the control by the warning-light control section 374*c* at the time of the third operation (third control) is different from the flowchart of the control by the sound control section 374*b* at the time of the third operation (third control) in FIG. 25 in that S303 is changed to "Turn on Warning Light" and S304 is changed to "Turn off Warning Light," and the other steps are the same as those in FIG. 25.

Operation/Effects (1) Excavation Work (Arm-Crowding Operation)

In a case in which excavation work is performed with the hydraulic excavator 1 configured in the manner explained above, first, the claw tip of the bucket 10 is moved to an excavation start position which is apart from the machine-body 1B and on a ground surface, and, in this state, arm-crowding operation is input via the operation device 45*b*. At this time, the operation deciding section 66 of the controller 40 decides that the operation is "first operation" on the basis of the flow in FIG. 8, and outputs the decision result to the actuator control section 81 and the notification control section 374. Thereby, the actuator control section 81 starts the flow in FIG. 9, the display control section 374*a* starts the flow in FIG. 12, the sound control section 374*b* starts the flow in FIG. 14 (explanation of the warning-light control section 374*c* is omitted for convenience), and the boundary line 650 between the deceleration area 600 and the non-deceleration area 620 is set to the position of +Ya1 [m] from the target surface 700.

On the basis of the flow in FIG. 9, the actuator control section 81 executes MC of controlling at least one of the hydraulic actuators 5, 6 and 7 such that, while the claw tip of the bucket 10 is moved in the deceleration area 600 by arm-crowding operation, a vertical component (component vertical to the target surface 700) of the velocity vector at the claw tip decreases as the claw tip comes closer to the target surface 700. Thereby, the vertical component of the velocity vector of the claw tip becomes zero on the target surface 700, and so an operator can perform excavation along the target surface 700 only by inputting arm-crowding operation.

(2) First Withdrawing Work (Boom-Raising Operation and Arm-Dumping Operation)

After the excavation work of (1) explained above is completed, the operator moves the bucket 10 in the direction away from the machine-body 1B (in the machine-body forward direction) by inputting boom-raising operation and arm-dumping operation via the operation devices 45*a* and 45*b*. If arm-dumping operation is input at this time, the operation deciding section 66 of the controller 40 decides that the operation is "third operation" on the basis of the flow in FIG. 8, and outputs the decision result to the actuator control section 81 and the notification control section 374. Thereby, the actuator control section 81 starts the flow in FIG. 21, the display control section 374*a* starts the flow in FIG. 24, the sound control section 374*b* starts the flow in FIG. 25 (explanation of the warning-light control section 374*c* is omitted for convenience), and the boundary line 650 between the deceleration area 600 and the non-deceleration area 620 is set to the position of +Ya2 [m] from the target surface 700.

Typically, the claw tip of the bucket 10 goes out of the deceleration area 600 and moves to the non-deceleration area 620 during the first withdrawing work. Then, from the perspective of improving the work efficiency, preferably the claw tip of the bucket 10 goes out of the deceleration area 600 in the shortest possible route, and after having gone out once, the bucket 10 is moved in the forward direction of the machine-body 1B such that it does not go into the deceleration area 600 again. In this regard, the hydraulic excavator 1 of the present embodiment always displays a positional relationship among the claw tip of the bucket 10, the target surface 700 and the boundary line 650 on the display screen of the display device 53*a* by the flow in the FIG. 24 performed by the display control section 374*a*. Accordingly, the operator can operate the front work device 1A while checking, in the first withdrawing work and on the display screen, how he/she should move the bucket 10 to make it go out of the deceleration area 600 quickly, and also how he/she should move the bucket 10 after making it go out of the deceleration area 600 such that it does not go into the deceleration area 600 again.

In addition, in the first withdrawing operation (third operation) whose main purpose is to move the bucket 10 in the machine-body forward direction, the state where the distance between the target surface 700 and the bucket 10 is short persists as compared to that in second withdrawing operation (second operation) that follows, and so it can be said that it is relatively more likely that the claw tip of the bucket 10 goes into the target surface 700. In view of this, in the present embodiment, the height (Ya2) of the boundary line 650 during the first withdrawing operation (third operation) is set higher than the height (0.8Ya2) during the second withdrawing operation (second operation) to create a situation where the bucket 10 can relatively easily go into the deceleration area 600 (i.e. a situation where it is difficult for the bucket 10 to come close to the target surface 700), thereby preventing the bucket 10 from going into the target surface 700 during the first withdrawing operation (third operation). In addition, since the ratio of decrease of the deceleration rate h is also set higher than that for the second withdrawing operation (second operation), deceleration of the bucket after having gone into the deceleration area 600 is made more rapid, and it is possible to prevent the bucket from going into the target surface 700 more effectively.

Furthermore, in the present embodiment, even in a situation where the bucket 10 is about to go into the deceleration area 600 again while an operator is not staring at the display screen, the sound control section 374*b* outputs an alarm, and the warning-light control section 374*c* turns on a warning light if the bucket 10 goes into the informing area 640. That is, it is possible in the present embodiment to give an operator notice the fact that the bucket 10 is about to go into the deceleration area 600 by the alarm and the warning light before the bucket 10 goes into the deceleration area 600, and so it is possible to prevent the bucket 10 from going into the deceleration area 600 again during the withdrawing work even if the operator is not staring at the display screen.

(3) Second Withdrawing Work (Boom-Lowering Operation and Arm-Dumping Operation)

After the first withdrawing work of (2) explained above, the operator inputs combined operation of arm-dumping operation and boom-lowering operation via the operation devices 45*a* and 45*b*, or input only boom-lowering operation via the operation device 45*a* to thereby move the bucket 10 again to the excavation start position. If combined operation of arm-dumping operation and boom-lowering operation is input at this time, the operation deciding section 66 of the controller 40 decides that the operation is the "second operation" on the basis of the flow in FIG. 8, and outputs the decision result to the actuator control section 81 and the notification control section 374. Thereby, the actuator control section 81 starts the flow in FIG. 16, the display control section 374*a* starts the flow in FIG. 19, the sound control section 374*b* starts the flow in FIG. 20 (explanation of the warning-light control section 374*c* is omitted for convenience), and the boundary line 650 between the deceleration area 600 and the non-deceleration area 620 is set to the position of +0.8Ya2 [m] from the target surface 700.

Typically, the claw tip of the bucket 10 is moved from the non-deceleration area 620 to the deceleration area 600 again during the second withdrawing work. There is a fear that if the timing of the boom-lowering operation is too early, the length of time during which the bucket 10 is in the deceleration area 600 increases, and the work efficiency deteriorates. In addition, there is a fear that even if the length of time during which the bucket 10 is in the deceleration area 600 can be reduced by delaying the timing of boom-lowering operation (e.g. by performing only boom-lowering operation after performing only arm-dumping operation), the length of time of the second withdrawing work itself increases in a case in which the timing of the boom-lowering operation is too late, and the work efficiency deteriorates.

In addition, in the second withdrawing operation (second operation) whose main purpose is to bring the bucket 10 after having moved in the machine-body forward direction in the first withdrawing operation (third operation) close to the ground surface, the height (0.8Ya2) of the boundary line 650 is set lower than the height (Ya2) during the first withdrawing operation (third operation) to create a situation where the bucket 10 can be relatively easily brought close to the ground surface, thereby enabling more efficient withdrawing operation. In addition, since the ratio of decrease of the deceleration rate h is also set lower than that for the first withdrawing operation (third operation), the degree of deceleration of the bucket after having gone into the deceleration area 600 is low, and it is made easier to bring the bucket 10 closer to the ground surface.

However, since a positional relationship among the claw tip of the bucket 10, the target surface 700 and the boundary line 650 is always displayed on the display screen of the display device 53*a* in the hydraulic excavator 1 of the present embodiment, an operator can operate the front work device 1A while checking on the display screen at which timing in the second withdrawing work he/she should input boom-lowering operation.

Furthermore, in the present embodiment, even in a situation where the bucket 10 is about to go into the deceleration area 600 at timing not intended by an operator, it is possible to give the operator notice that the bucket 10 is coming closer to the deceleration area 600 by an alarm and a warning light that are output and turned on when the bucket 10 has gone into the informing area 640, and so it is possible to prevent the bucket 10 from going into the deceleration area 600 at timing not intended by the operator.

In addition, it is configured in the hydraulic excavator 1 according to the present embodiment that the position of the boundary line 650 (the height of the boundary line 650 as measured from the target surface 700) between the deceleration area 600 and the non-deceleration area 620 is changed depending on operation of the front work device 1A. For example, in a case in which (1) excavation work, (2) first withdrawing work and (3) second withdrawing work like the ones explained above are performed consecutively, this results in the position of the boundary line 650 changing in the order of Ya1 [m], Ya2 [m] and 0.8Ya2 [m], but it is very difficult for an operator to accurately grasp the changes instinctively. However, since the position of the boundary line 650 on the display screen is also changed in accordance with positional changes of the boundary line 650 accompanying operator operation (operation of the work implement 1A) in the present embodiment, the operator can grasp the positional changes of the boundary line 650 easily.

As mentioned thus far, according to the present embodiment, the position of the boundary line 650 between the deceleration area 600 in which MC is executed and the non-deceleration area 620 in which MC is not executed is displayed on the display device 53*a* along with the position of the bucket 10. Since an operator can operate the front work implement 1A by referring to the display screen thereby, it is possible to reduce the length of time during which the front work implement 1A passes through the deceleration area 600 in which MC is executed, at timing not intended by the operator, and the work efficiency can be improved.

Others

Note that the present invention is not limited to the embodiments explained above, but includes various variants within a scope not deviating from the gist of the present invention. For example, the present invention is not limited to those including all the configurations explained in the embodiments explained above, but also includes those from which some of the configurations are eliminated. In addition, some of configurations related to an embodiment can be added to or replace configurations according to another embodiment.

Figure 28:
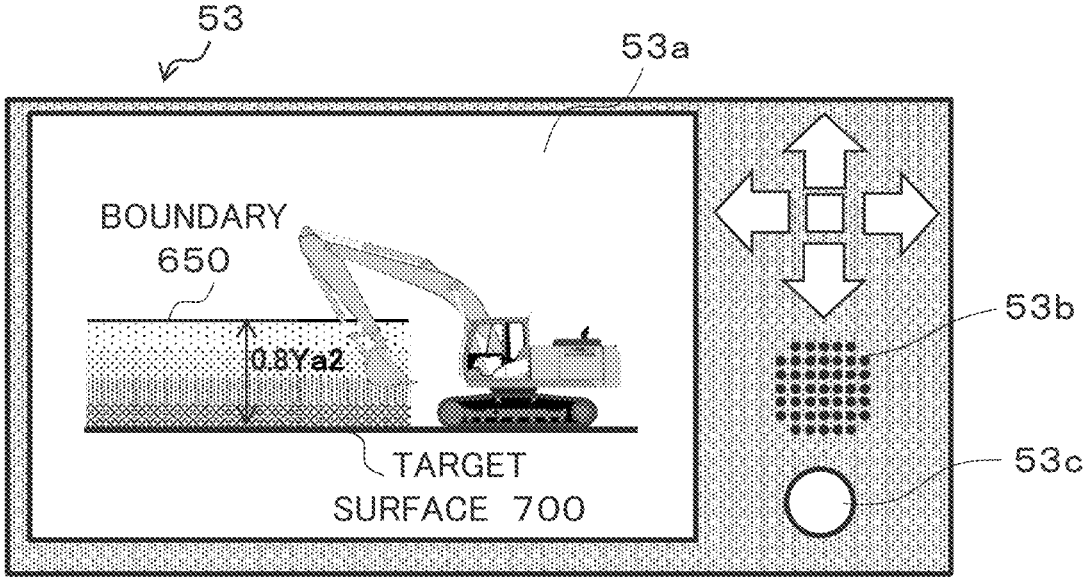
FIG. 28 is an example of presentation of the deceleration rate h in a deceleration area 600 on a screen of a display device 53*a* with colors.

For example, the forms of notification by the notification device 53 according to the present invention are not limited to the ones explained above, but can be changed in various manners. For example, the display controller 374*a* may be configured to present, with colors on the display screen of the display device 53*a*, the degree at which the vertical component of the tip velocity vector of the work implement 1A is decelerated as the tip of the work implement 1A comes closer to the target surface 700 in the deceleration area 600. FIG. 28 illustrates an example in which the deceleration rate h is presented with colors in the deceleration area 600 on the screen of the display device 53*a*, and as the deceleration rate h becomes close to zero, the densities of colors that are displayed increase. By configuring the screen of the display device 53*a* such that an operator can recognize the deceleration rate h visually in this manner, it is possible to attempt to improve the work efficiency by performing operation in such a manner that the bucket 10 is caused to pass through an area of a deceleration rate which is close to 1 as much as possible even in a situation where, for example, there are physical movement restrictions or the like, and unavoidably the bucket 10 has to be moved in the deceleration area 600.

Figure 29:
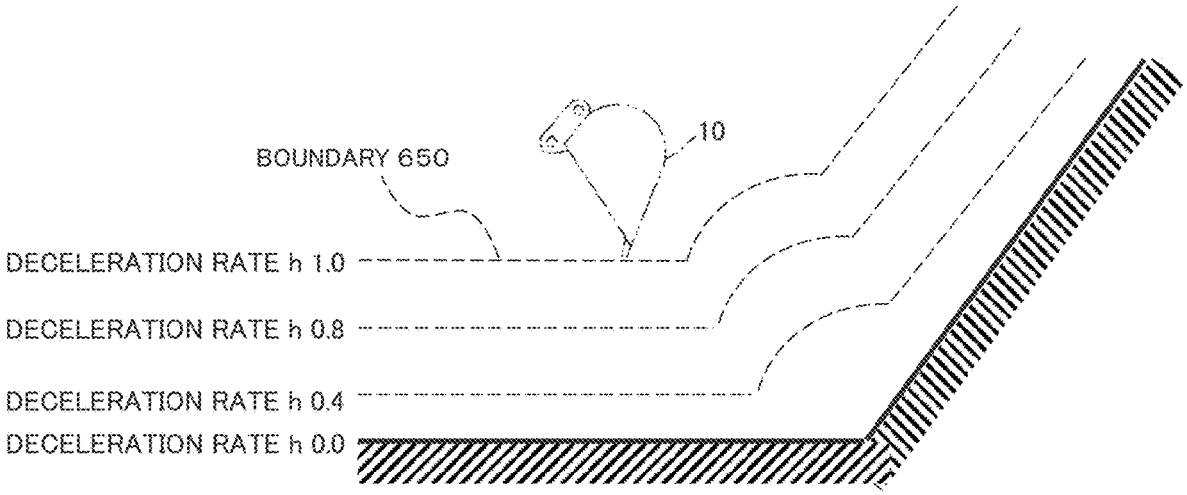
FIG. 29 is a figure illustrating one example of the case in which the deceleration rate h is changed while taking into consideration the distance from an intersection between two target surfaces.

Although in the case explained above, the height of the boundary line 650 from the target surface 700 is changed depending on a result of decision by the operation deciding section 66, the height of the boundary line 650 may be changed depending on the shape of a target surface as illustrated in FIG. 29. For example, in the example of FIG. 29, for portions whose distances from the intersection between the two target surfaces are short, the height of the boundary line 650 from the target surface 700 is set such that the height of the boundary line 650 becomes higher than that for the other portions. In a case in which changes of the height of the boundary line 650 are not uniform, and it is difficult for an operator to make intuitive predictions as illustrated in FIG. 29, the advantage of displaying the boundary line 650 as in the present invention becomes more significant.

In addition, only a case where changes of the deceleration rate h in the deceleration area 600 are uniform (i.e. the deceleration rate h changes depending on the target-surface distance Ya) is explained above, the deceleration rate h may be change taking into consideration another factor (the distance from the intersection between two target surfaces) as illustrated in FIG. 29. For example, in the example of FIG. 29, for portions whose distances from the intersection between the two target surfaces are short, the deceleration rate is set so as to decrease even if their distances from the target surface 700 are longer than those of the other portions. In a case in which changes of the deceleration rate h in the deceleration area 600 are not uniform and it is difficult for an operator to make intuitive predictions as illustrated in FIG. 29, the advantage of presenting the deceleration rate h with colors as illustrated in FIG. 28 becomes more significant.

Figure 30:
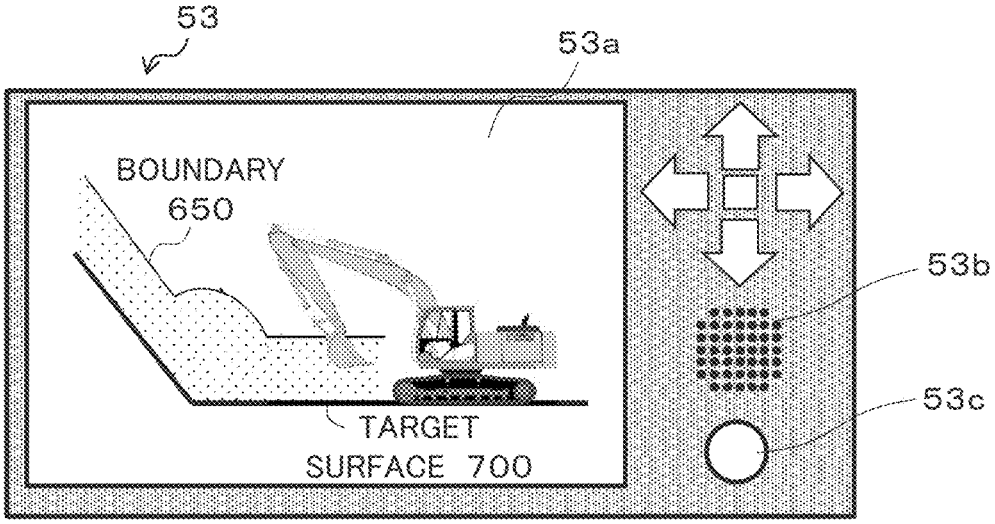
FIG. 30 is one example of the display screen of the display device 53*a* in a case in which the deceleration rate h is set as illustrated in FIG. 29.

FIG. 30 is one example of the display screen of the display device 53*a* in a case in which the deceleration rate h is set as illustrated in FIG. 29. As illustrated in this figure, the shape of the boundary line 650 between the deceleration area 600 and the non-deceleration area 620 is allowed to be a non-linear shape.

Although the values (Ya1, 0.8Ya2 and Ya2) of the distance from the target surface 700 to the boundary line 650 are displayed on the screen of the display device 53*a* in FIGS. 13, 26 and 27 and the like, they can be omitted. In addition, although not only the bucket 10, but the entire hydraulic excavator 1 is displayed in these figures, only the bucket 10 may be displayed, or the bucket 10 and the arm 9, or the bucket 10, the arm 9 and the boom 8 (i.e. the entire front work implement 1A) may be displayed as one set. That is, there are particularly no limitations in the manner of display as long as the bucket 10 is included.

The alarm output by the sound control section 374*b* may be made different between the informing area 640 and the deceleration area 600 in order to make an operator recognize which of the informing area 640 and the deceleration area 600 the claw tip is in.

In addition, an alarm output when the bucket 10 is in the informing area 640 may have a sound cycle that is changed depending on the distance from the boundary line 650 to the claw tip. For example, the sound cycle may be made shorter when the bucket 10 is in an area where the distance is short, and the sound cycle may be made longer when the bucket 10 is in an area where the distance is long. In a case in which the sound is changed depending on the magnitude of the distance in this manner, it is possible to perform operation such that the tip portion of the bucket 10 passes through the non-deceleration area 620 by distinguishing the sound, and so it is possible to attempt to make the withdrawing operation efficient.

Furthermore, an alarm output when the bucket 10 is in the deceleration area 600 may have a sound cycle that changes depending on the deceleration rate h. For example, the sound cycle may be made shorter when the bucket 10 is in an area where the deceleration rate h is high (an area where h is close to 0), and the sound cycle may be made longer when the bucket 10 is in an area where the deceleration rate h is low (an area where h is close to 1). In a case in which the sound is changed depending on the magnitude of the deceleration rate h in this manner, it is possible to perform operation such that the tip portion of the bucket 10 passes through the area of the low deceleration rate h by distinguishing the sound, and so it is possible to attempt to make the withdrawing operation efficient.

In addition, the condition under which an alarm is issued (the condition under which the process proceeds to S303) may include not only the condition of S302, but additionally include a condition that the vertical component Vcy of the tip velocity vector Vc of the bucket 10 is negative (i.e. the claw tip is coming closer to the target surface 700). By adding this condition, it is possible to issue an alarm only in a case in which operation of bringing the claw tip closer to the target surface 700 is being performed.

In addition, an alarm may be issued only when the bucket 10 is in the informing area 640, and an alarm may not be issued when the bucket 10 is in the deceleration area 600. In addition, the alarm may be a sound.

In addition, each configuration related to the controller 40 explained above, and the function, execution process and the like of such each configuration may be partially or entirely realized by hardware (e.g. designing logic to execute each function in an integrated circuit or the like). In addition, configurations related to the controller 40 explained above may be a program (software) that is read out and executed by a calculation processing device (e.g. a CPU) to realize each function related to the configurations of the controller. Information related to the program can be stored on, for example, a semiconductor memory (a flash memory, an SSD or the like), a magnetic storage device (a hard disk drive or the like), a recoding medium (a magnetic disk, an optical disc or the like) and the like.

In addition, although control lines and information lines that are deemed to be necessary for explanation of embodiments are illustrated in the explanation of each embodiment explained above, all control lines and information lines related to products are not necessarily illustrated. It may be considered that actually almost all configurations are connected mutually.

DESCRIPTION OF REFERENCE CHARACTERS

1A: Front work implement
8: Boom
9: Arm
10: Bucket
30: Boom-angle sensor
31: Arm-angle sensor
32: Bucket-angle sensor
40: Controller
43: MG/MC control section
43*a*: Operation-amount calculating section
43*b*: Posture calculating section
43*c*: Target-surface calculating section
44: Solenoid-proportional-valve control section
45: Operation device (boom, arm)
46: Operation device (bucket, swing)
50: Work-device-posture sensor
51: Target-surface setting device
52*a*: Operator-operation sensor
53: Notification device
53*a*: Display device
53*b*: Sound output device
53*c*: Warning-light device
54, 55, 56: Solenoid proportional valve
66: Operation deciding section
81: Actuator control section
374: Notification control section
374*a*: Display control section
374*b*: Sound control section
374*c*: Warning-light control section
600: Deceleration area (first area)
620: Non-deceleration area (second area)
640: Informing area
650: Boundary line
700: Target surface

The invention claimed is:

1. A work machine comprising:
an articulated-type work implement;
a plurality of hydraulic actuators that drive the work implement;
an operation device that instructs the work implement to operate depending on operation performed by an operator;
a controller that executes machine control of operating the work implement in accordance with a predetermined condition in a case in which the work implement is positioned in a first area set above a target surface set as desired, and that does not execute the machine control in a case in which the work implement is positioned in a second area set above the first area; and
a display device on which a positional relationship between the target surface and the work implement is displayed, wherein
the controller
decides operation of the work implement on a basis of an operation amount of the operation device;
displays, on the display device, a positional relationship among the work implement, the target surface and a boundary line between the first area and the second area;
executes the machine control while changing a position of the boundary line depending on a result of the decision of the operation of the work implement; and
changes a display position of the boundary line on the display device, depending on the result of the decision of the operation of the work implement.

2. The work machine according to claim 1, wherein
the work implement has an arm and a boom, and
the controller
decides that a first withdrawing operation is being performed in a case in which an arm-dumping operation is input to the operation device but a boom-lowering operation is not input to the operation device, and decides that a second withdrawing operation is being performed in a case in which an arm-dumping operation and a boom-lowering operation are input to the operation device; and
makes a position of the boundary line higher when it is decided that the first withdrawing operation is being performed than when it is decided that the second withdrawing operation is being performed.

3. The work machine according to claim 1, wherein
the controller further changes the display position of the boundary line on the display device depending on a shape of the target surface.

4. The work machine according to claim 1, wherein, as the machine control, the controller controls at least one of the plurality of hydraulic actuators such that a vector component of a velocity vector in a direction toward the target surface at a tip portion of the work implement decreases as the tip portion of the work implement comes closer to the target surface.

5. The work machine according to claim 4, wherein the controller presents, with a color on the display device, a degree of deceleration of the vector component of the velocity vector in the direction toward the target surface at the tip portion of the work implement, the deceleration being executed by the machine control.

6. The work machine according to claim 1, further comprising:

a sound output device that produces a sound in a case in which the work implement has come close to the first area.

7. The work machine according to claim 1, further comprising:

a warning light that is turned on in a case in which the work implement has come close to the first area.

* * * * *